US007371350B2

(12) United States Patent
Jones et al.

(10) Patent No.: US 7,371,350 B2
(45) Date of Patent: May 13, 2008

(54) OXYGEN GENERATOR

(75) Inventors: David Jones, Chelmsford (GB); Amanda Jayne Crudace, West Wickham (GB); Peter Alan Hutchinson, Chelmsford (GB)

(73) Assignee: Molecular Oxygen Limited, Essex (GB)

( * ) Notice: Subject to any disclaimer, the term of this patent is extended or adjusted under 35 U.S.C. 154(b) by 766 days.

(21) Appl. No.: 10/479,820

(22) PCT Filed: Jun. 7, 2002

(86) PCT No.: PCT/GB02/02603

§ 371 (c)(1),
(2), (4) Date: Dec. 4, 2003

(87) PCT Pub. No.: WO02/098512

PCT Pub. Date: Dec. 12, 2002

(65) Prior Publication Data

US 2004/0151639 A1 Aug. 5, 2004

(30) Foreign Application Priority Data

Jun. 7, 2001 (GB) ..... 0113849.4

(51) Int. Cl.
*A62B 7/08* (2006.01)

(52) U.S. Cl. ..... 422/120; 422/125; 422/126

(58) Field of Classification Search ..... 422/120, 422/125, 126

See application file for complete search history.

(56) References Cited

U.S. PATENT DOCUMENTS 1,892,050 A 12/1932 Goss
2,469,414 A 5/1949 Schechter
2,558,756 A 7/1951 Jackson et al.
2,775,511 A 12/1956 Geffroy et al.
3,207,695 A 9/1965 Gustafson
3,233,187 A 2/1966 Raffel
3,276,846 A 10/1966 Moni et al.
3,516,797 A * 6/1970 Bovard et al. ..... 422/120
3,615,251 A 10/1971 Klenk
3,702,305 A 11/1972 Thompson
3,736,104 A 5/1973 Churchill et al.
3,742,683 A 7/1973 Sebest et al.
3,861,880 A * 1/1975 Thompson ..... 422/122

(Continued)

FOREIGN PATENT DOCUMENTS

EP 0363913 4/1990

(Continued)

OTHER PUBLICATIONS

"Fiberfrax"; www.fiberfrax.com.*

(Continued)

*Primary Examiner*—Gladys J P Corcoran
*Assistant Examiner*—Sean E Conley
(74) *Attorney, Agent, or Firm*—Stout, Uxa, Buyan & Mullins, LLP; Frank J. Uxa

(57) ABSTRACT

An oxygen generator comprising an oxygen generating unit including: (a) a chlorate oxygen generating candle for generating oxygen when ignited; and (b) an ignition device for igniting the candle to initiate oxygen generation from the candle. The candle is arranged during operation to sustain propagation of a plurality of burn fronts therethrough, the fronts propagating in different directions.

14 Claims, 18 Drawing Sheets

U.S. PATENT DOCUMENTS

| | | | | |
|---|---|---|---|---|
| 4,891,189 | A | | 1/1990 | Harwood, Jr. |
| 4,981,655 | A | | 1/1991 | Kolbe et al. |
| 5,338,516 | A | * | 8/1994 | Zhang et al. ..... 422/126 |
| 5,620,664 | A | | 4/1997 | Palmer |
| 5,750,077 | A | | 5/1998 | Schoen |
| 6,007,736 | A | | 12/1999 | Zhang et al. |

FOREIGN PATENT DOCUMENTS

| | | | | |
|---|---|---|---|---|
| EP | 0736486 | | | 10/1996 |
| GB | 2322126 | | | 8/1998 |
| JP | 09084891 | A | * | 3/1997 |

OTHER PUBLICATIONS

Machine Translation for JP 09084891A; http://www19.ipdl.inpit.go.jp/PA1/cgi-bin/PA1INDEX.*

* cited by examiner

OXYGEN GENERATOR

The present invention relates to oxygen generators and in particular, but not exclusively, to oxygen generators for generating breathable oxygen by way of chemical reaction.

BACKGROUND TO THE INVENTION

Oxygen generation within apparatus by way of chemical reaction is known. For example, chemical oxygen generators employing alkali metal chlorates are described in U.S. Pat. Nos. 3,702,305; 2,469,414; 2,558,756; 2,775,511; 3,207,695; 3,276,846 and 3,233,187; oxygen generation occurs in these generators at elevated temperature in excess of 200° C. as metal chlorate therein is reduced to its corresponding metal chloride.

In U.S. Pat. No. 5,750,077, there is described a device for delivering breathable oxygen, the device utilising an endothermic reaction wherein potassium chlorate ($KClO_3$) is catalyzed in the presence of manganese dioxide ($MnO_2$) to yield potassium chloride (KCl) and oxygen gas. In the device, the endothermic reaction is initiated by using battery-powered resistive heating fingers which, in operation, heat the $KClO_3$ and the $MnO_2$ to at least 200° C. above which the reaction is exothermic and thus self-sustaining. The device comprises a battery for initiating the reaction, a replaceable oxygen generating canister including the $KClO_3$ and $MnO_2$ materials, and a filter canister. The battery is designed to connect onto a first end of the oxygen generating canister. The filter canister is designed to couple onto a second end of the oxygen canister remote from the first end. The filter canister is in gaseous communication with the oxygen generating canister and is connected via an oxygen flow tube to a face mask of the device for interfacing to a user's face whereat the oxygen is dispensed. The filter canister includes a carbon filter for removing impurities and for inhibiting reactant transmission from the oxygen generating canister to the face mask and hence to the user. Moreover, the oxygen generating canister includes a composite thermal insulator comprising metallized thin films interspersed with low thermal-conductivity foams for insulating the potassium chlorate and manganese dioxide materials from ambient environment.

In U.S. Pat. No. 3,736,104, electrically and chemically initiated thermal oxygen generators are described, the generators operable to deliver oxygen at their associated outlet tubes at a relatively high temperature oxygen in a range of 210° C. to 238° C. rendering the oxygen unsuitable for direct human inhalation.

Thermal management in the aforementioned oxygen generators represents a problem which is considered in U.S. Pat. No. 5,620,664. In this patent, a portable dispenser of medically pure oxygen is described. The dispenser includes a disposable oxygen generator comprising a compressed metal chlorate or oxide briquette of hexagonal cross-section having first and second tapered ends, the first end including a recess therein for receiving a water-activatable ignition material in the form of an ignition cone. Water for activating the ignition material is provided from a sealed water-filled chamber. In order to bring the briquette into operation, a user depresses a user-actuated ignition pin which punctures the chamber for releasing the water therein onto the ignition material which subsequently ignites and, in turn, ignites the briquette. The dispenser also includes a helical tubular coil through which oxygen generated by the briquette is passed for providing corresponding cooled oxygen which is delivered to the user.

In the portable dispenser, a region surrounding the briquette is devoid of insulation allowing uninhibited heat radiation from the briquette. However, the briquette is provided with supporting mats at the first and second ends thereof for mechanically clamping the briquette within the dispenser. The briquette is tapered at its first end in the vicinity of the ignition material to prevent sudden oxygen outpouring when the reaction within the briquette is initiated. As the reaction within the briquette proceeds, the temperature of the briquette tends to increase which accelerates the reaction, the tapered second end providing a reducing reaction cross-sectional area which assists to reduce the rate of reaction and thereby maintain a more constant oxygen delivery rate from the dispenser as the briquette is consumed.

Thus, there arises a first problem that thermal insulation included around the briquette increases briquette temperature on account of thermal energy being retained within the briquette. Such retention causes an increased rate of reaction within the briquette with an associated increased rate of oxygen generation. Conversely, an absence of thermal insulation results in the dispenser becoming relatively hot at its peripheral surface in use. Moreover, uniform oxygen generation rate is a second problem which arises in known oxygen generators. The present invention has been devised to address at least one of the first and second problems.

SUMMARY OF THE INVENTION

According to a first aspect of the present invention, there is provided an oxygen generator comprising:

(a) chemical oxygen generating means for generating oxygen when ignited; and (b) ignition means for igniting the generating means to initiate oxygen generation from the generating means, the generating means being arranged during operation to sustain propagation of a plurality of burn fronts therethrough, the fronts propagating in generally mutually different directions.

The oxygen generating means may, for example, comprise at least one first element positioned and arranged for ignition by the igniting means, and a plurality of second elements each positioned and arranged for ignition by a first element, so that in operation a plurality of burn fronts is propagated through the at least one first element and through the plurality of second elements, the direction of propagation of one of the burn fronts differing from the direction of propagation of at least one other of the burn fronts.

The ignition means may, for example, be located in the central region of an oxygen generator of a generally cylindrical shape, the length of the generator being greater than its diameter so that in operation two burn fronts are propagated from the central region toward opposite ends of the generator. In this case also, there are preferably provided at least one first element of the generating means arranged for ignition by the ignition means and a plurality of second elements for ignition by a first element. As will be explained in greater detail below, there may be a succession of elements extending toward one or preferably both ends of the generator, each arranged for ignition by the immediately preceding element.

The invention is of advantage in that the generator is capable of providing a more accurately controlled supply of oxygen, and/or distributing heat generated within the generating means more uniformly in operation.

A burn front is defined as an interface region bounded by unburnt and burnt regions of the generating means. In operation, the burn front propagates towards unburnt regions.

Preferably, in operation, there are two burn fronts and they propagate away from each other in generally mutually opposite directions. Preferably, the generating means comprises an elongate oxygen generating candle including the igniting means at a substantially longitudinally central region thereof. Positioning the igniting means centrally enables burn fronts to propagate from the central region to ends of the candle in a plurality of directions. Moreover, thermal energy released at initial ignition of the candle is advantageously kept remote from ends of the candle, highest candle temperatures arising at initial ignition. Non-disposable parts, e.g., an electrical ignition device, especially a coil and electric leads to the coil, and insulation, both thermal and electrical, of the generator located near the ends are susceptible to damage from such high temperatures if exposed directly thereto.

Preferably, the generating means is spatially substantially symmetrical in composition relative to the igniting means. Such symmetry provides the benefit that burn fronts propagate away from the central region at substantially similar rates. More preferably, the generating means comprises one or more of a metal chlorate and metal perchlorate material system for combustably generating oxygen.

Preferably, the generating means is materially step-wise graded spatially away from the igniting means into stages. Such step-wise construction enables the candle to be fabricated from discrete components assembled together, such components being easier to manufacture to have uniform composition. More preferably, the stages are progressively more chemically inert away from the igniting means; such a configuration improves stability of the candle and renders it less susceptible to spontaneous or accidental ignition.

Preferably, interface surfaces between adjacent stages are substantially of frusto-conical form. Such a frusto-conical form is especially advantageous for achieving a well-controlled burn-front propagation from one stage to another, thereby rendering the candle more reliable in use. In order to ease fabrication of the stages, the interface surfaces can be implemented in step-wise frusto-conical form.

The generating means is susceptible to assembly in a plurality of ways. Thus, preferably, the generating means comprises oxygen generating materials, advantageously solid at room temperature, in one or more of cast, loose-filled, compressed or pelletized form; certain of the aforesaid stages can be fabricated in mutually different forms, for example to reduce manufacturing costs.

The ignition means is preferably one or more of an electrically resistive heating device, a percussion cap detonator and a cartridge ignition device. If desired, the candle can include more than one type of ignition device. Electrically resistive heating devices are of advantage in that they are intrinsically safe until energized.

Preferably, the igniting means comprises a resistive heating device, and the generator further comprises electronic controlling means for controlling electrical power applied to the heating device to initiate combustion within the generating means. Use of electronic controlling means enables an improved degree of ignition control to be achieved and can enable the generator to be rendered more tamper-proof. Indeed, the controlling means preferably includes coupling means for inductively coupling electrical power from the controlling means to the heating device; such inductive coupling is of benefit in that exposed electrical contacts can be avoided in the generator, such contacts being susceptible to oxidation when in storage and therefore being potentially unreliable.

Preferably, in order to conserve battery power and yet ensure reliable ignition of the generating means, the controlling means includes timing means for automatically controlling a period during which electrical power is applied to the heating device for initiating combustion within the generating means.

When electrical or electronic ignition is employed, it is desirable that the controlling means includes at least one battery for providing electrical power for the igniting means to initiate oxygen generation within the generating means, the controlling means further comprising battery monitoring means for monitoring remaining power deliverable from the at least one battery. The monitoring means is of advantage in that it indicates to a user of the generator whether or not the battery needs to be replaced.

On account of the generator being potentially employed in a wide range of circumstances, the monitoring means desirably includes a light emitting diode indicator and/or a liquid crystal display indicator for indicating remaining power deliverable from the at least one battery. Light emitting diode indicators are more visible in subdued lighting, for example at dusk or night-time, whereas liquid crystal display indicators are more visible in strong illumination, for example in bright sunlight on a mountaintop.

In operation, considerable thermal energy is generated in the generating means as oxygen is emitted therefrom. In order to protect users of the generator thermally, the generating means preferably includes insulating means for reducing the rate of thermal energy flow from an interior region of the generating means whereat oxygen generation occurs. Most preferably, the insulating means is of a substantially hollow form, and may be cylindrical.

The insulating means is required to withstand high temperatures within the generating means whilst simultaneously providing a thermal insulation characteristic. Thus, preferably, the insulating means is fabricated from a microporous material capable of operating at temperatures of at least 1000° C.

On account of the generator being conceived to be a portable product, the microporous material preferably has a density in a range of 150 to 400 kg/m$^3$. Such a density is capable of rendering the generator of convenient weight to be personnel-wearable.

On account of the aforesaid high temperatures arising in the generating means when in operation, oxygen released therefrom is too hot for direct user inhalation. Thus, preferably, the generating means comprises a peripheral path through which, in use, oxygen generated by the generating means is conveyed for cooling the oxygen prior to dispensing the cooled oxygen to a user of the generator.

In order to render the generator economical in use, it preferably comprises a disposable part and a retainable part. Thus, conveniently, the generator comprises a retainable cap and a disposable oxygen generating unit, the cap including the controlling means and the generating unit including the generating means and the igniting means.

Delivery of pure oxygen to users often requires medical supervision to reduce a risk of hyperventilation or potential cardio-vascular complications. Thus, preferably, the generator is operable to deliver oxygen-enriched air rather than pure oxygen, thereby circumventing a need for medical supervision. Therefore, preferably, at least one of the cap and the generating means include blending means for blending oxygen generated in the generating means with ambient air for providing oxygen-enriched air to a user of the generator for inhalation.

Once ignited in use, detachment of the cap from the generating unit can be potentially hazardous. Thus, preferably, the cap and the generating unit include interlocking means for locking the cap and generating unit together when in operation. Moreover, the interlocking means can be implemented in a number of different ways, namely the interlocking means is preferably operable to employ one or more of generated oxygen temperature, generated oxygen pressure and generating unit temperature for preventing detachment of the cap from the generating unit when in operation.

On account of the generating means employing a metal chlorate material, chlorine gas can potentially be generated within the generator when in use. Such chlorine gas can be toxic to a user of the generator. Thus, the generating means preferably includes at least one of copper and brass materials therein for absorbing chlorine generated in the generating means when the generator is in use.

For providing enhanced operating performance, it is desirable that the at least one of copper and brass materials perform other functions in addition to absorbing chlorine. Thus, the at least one of copper and brass materials preferably are included as perforated metal sheets in the generating means for assisting oxygen flow within the generating means and for preheating uncombusted regions of the generating means when the generator is in use. The perforated metal sheets additionally are of advantage in that they provide structural support to the generating means during combustion thereof when its physical dimensions change, such change being susceptible to blocking oxygen flow pathways within the generating means. Moreover, the sheets are also of benefit in that they assist with reproducibility of burn characteristics of the generating means when the generating means is mass-produced.

According to a second aspect of the present invention, there is provided an oxygen generator comprising:

(a) chemical oxygen generating means for generating oxygen when ignited; and (b) igniting means for igniting the generating means to initiate oxygen generation from the generating means, characterised in that the generator further includes electronic controlling means for controlling electrical power applied to the igniting means for igniting the generating means.

Preferably, the controlling means includes coupling means for inductively coupling electrical power from the controlling means to the igniting means. More preferably, the coupling means includes an electrical winding encircling a substantially central peripheral region of the generating means. Such inductive coupling circumvents the need to employ exposed electrical contacts which are susceptible to oxidation and potential user abuse.

Preferably, the controlling means includes timing means for automatically controlling a period during which electrical power is applied to the igniting means for initiating combustion within the generating means. Such timing means is of advantage in that it is capable of ensuring more reliable ignition of the generating means whilst conserving electrical power available within the generator.

According to a third aspect of the present invention, there is provided an oxygen generator comprising:

(a) chemical oxygen generating means for generating oxygen when ignited; and (b) igniting means for igniting the generating means to initiate oxygen generation from the generating means, characterised in that the generator further includes controlling means for controlling electrical power applied to the igniting means for igniting the generating means, the controlling means including timing means for automatically controlling a period during which electrical power is applied to the igniting means for initiating combustion within the generating means.

According to a fourth aspect of the present invention, there is provided an oxygen generator comprising:

(a) chemical oxygen generating means for generating oxygen when ignited; and (b) igniting means for igniting the generating means to initiate oxygen generation from the generating means, characterised in that the generator further comprises insulating means for at least partially thermally isolating the generating means from ambient, the insulating means being fabricated from a microporous material capable of operating at temperatures of at least 1000° C.

Preferably, the material of the insulating means is formed into a substantially hollow cylindrical component having one or more peripheral recesses for providing one or more cooling paths for cooling oxygen generated by the generating means.

According to fifth aspect of the present invention, there is provided an oxygen generator comprising:

(a) chemical oxygen generating means for generating oxygen when ignited; and (b) igniting means for igniting the generating means to initiate oxygen generation from the generating means, characterised in that the generator includes a cap and an oxygen generating unit, the cap including controlling means for controlling electrical power applied to the igniting means to initiate combustion within the generating means and the generating unit including the generating means and the igniting means, wherein the cap and the generating unit include interlocking means for locking the cap and generating unit together when in operation.

Preferably, the interlocking means is operable to employ one or more of generated oxygen temperature, generated oxygen pressure and generating unit temperature for preventing detachment of the cap from the generating unit when in operation.

DESCRIPTION OF THE DRAWINGS

Embodiments of the invention will now be described, by way of example only, with reference to the following drawings in which.

DESCRIPTION OF EMBODIMENTS OF THE INVENTION

Figure 1:
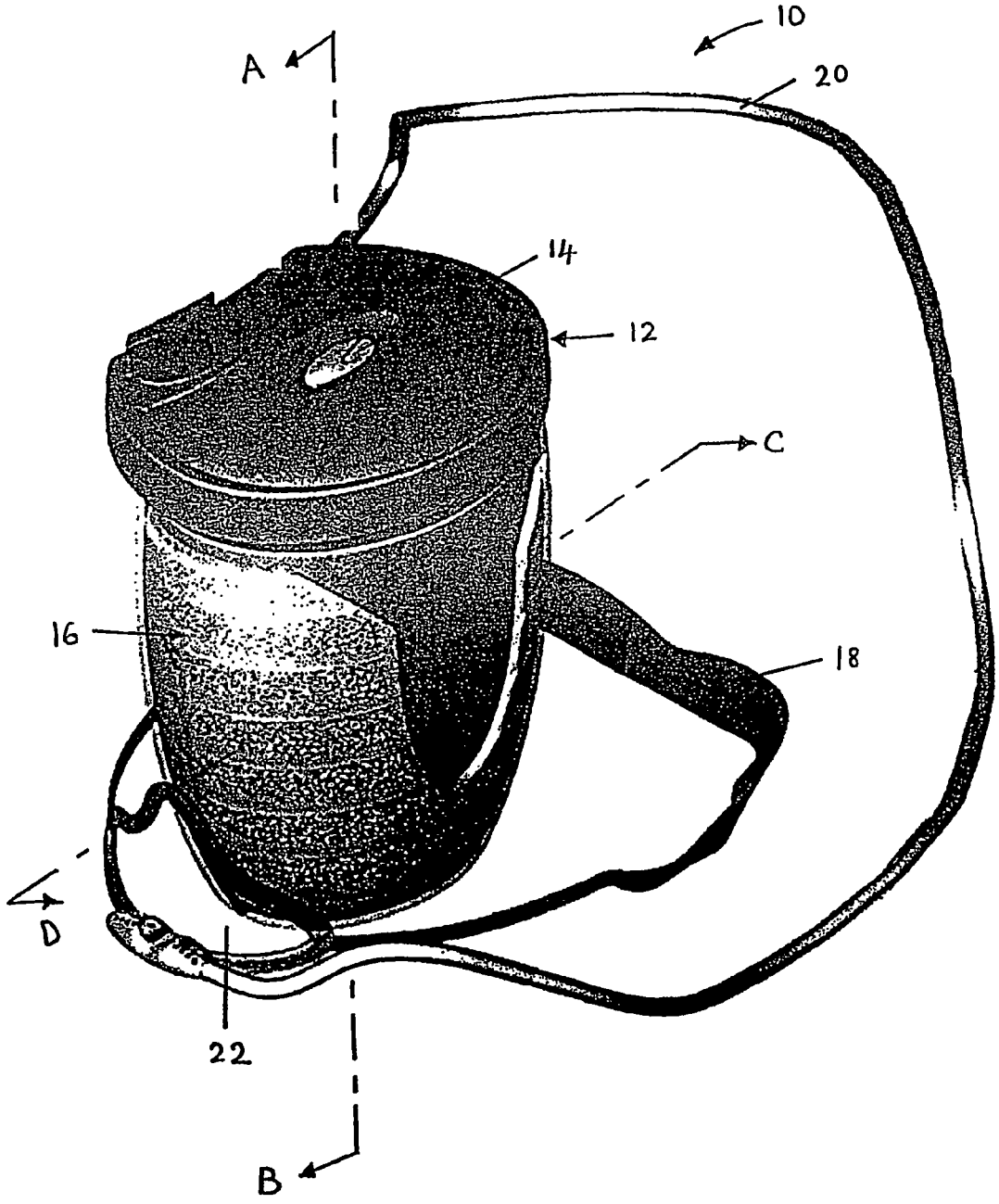
FIG. 1 is a schematic external view of an oxygen generator according to the invention, the generator comprising a cap, a disposable generating unit and a user-wearable headset.

In FIG. 1, there is shown an exterior view of an oxygen generator according to the invention, the generator being indicated generally by 10. The generator 10 comprises a cap 12 including an ignition button 14 disposed substantially centrally in an upper exposed surface thereof. The generator 10 also comprises a disposable oxygen generating unit 16 configured to interlock with the cap 12 as illustrated. The generator 10 further comprises an oxygen delivery tube 20 connecting from the cap 12 to a headset 22. The headset 22 is designed to interface to nose and mouth regions of a user and be retained thereon by way of an adjustable strap 18.

Operation of the generator 10 will now be described in overview.

The user takes the cap 12 and then twist-connects the generating unit 16 to an underside region of the cap 12. Next, the user attaches the headset 22 to his or her face and secures it thereto by adjusting the strap 18. Finally, the user depresses the button 14 to initiate a chemical reaction within the generator 10 which results in the generation of oxygen gas which passes from the generating unit 16 to the cap 12 whereat the oxygen gas is blended with ambient air to provide oxygen-enriched air. The enriched air then passes via the tube 20 to the headset 22 for user inhalation. The chemical reaction within the unit 16 continues for at least several minutes producing oxygen before active ingredients within the unit 16 are exhausted. The user finally removes the headset 22 and then, after a cooling period, twistably disconnects the generating unit 16 from the cap 12 and subsequently discards the unit 16. The cap 12 is retained for use with one or more replacement generating units similar in design to the unit 16.

The cap 12 is an injection moulded plastics material component housing an oxygen-air gas blender, an electrical battery and an electronic unit. The plastics material is one or more of ABS, glass-filled nylon, polyethylene, polypropylene, polycarbonate or filled silicone rubber. Other plastics materials can be alternatively employed.

The blender is included within the cap 12 for assisting with cooling oxygen gas generated within the unit 16 and for preventing pure oxygen from being delivered to the headset 22. For some users, inhalation of pure oxygen can be potentially dangerous and often requires a medical practitioner to be present. Such danger does not arise with oxygen enriched air, for example when the normal 20.8% oxygen content of air is enriched to a range of 30 to 50% oxygen. When high concentrations of oxygen are required approaching 100%, the generator 10 design is preferably modified to omit the blender or include a bypass device for bypassing the blender.

The electrical battery is included for providing electrical power to the unit 16 for initiating the oxygen-generating chemical reaction therein.

The tube 20 is fabricated from a flexible plastics material, for example silicone rubber. Likewise, the generating unit 16 has an outer casing of plastics material inside which is housed a thermal insulator and chemical ingredients in the form of a metal chlorate candle capable of generating oxygen when ignited. The metal chlorate comprises preferably one or more of sodium chlorate, potassium chlorate and a metal perchlorate. The headset 22 is also manufactured from a flexible plastics material, for example substantially transparent silicone rubber, so that the user's mouth and nose are visible during inhalation.

Figure 2:
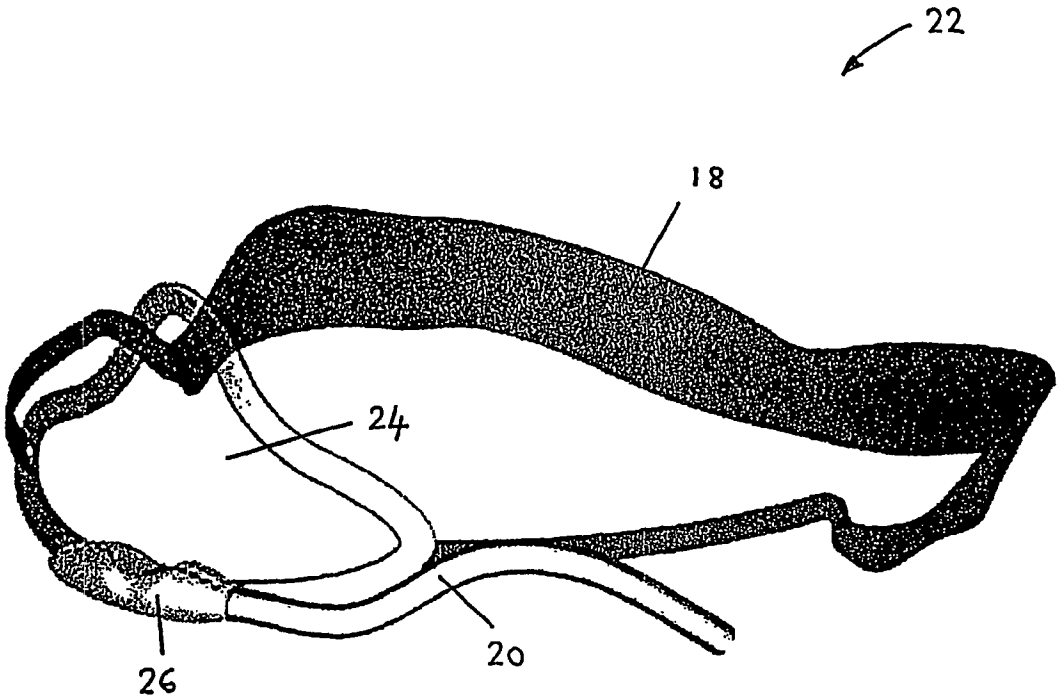
FIG. 2 is a schematic diagram of the headset.

In FIG. 2, the headset 22 is illustrated in more detail. The tube 20 is coupled to a mouth-nose face piece 24 by way of a coupler 26. The face piece 24 comprises a thickened region around its peripheral edge for rendering it more robust and for ensuring a satisfactory and comfortable seal around the user's mouth and nose. The strap 18 is attached to the face piece 24 at widest lateral regions thereof as illustrated.

If required, the tube 20 can include in-line therealong a metallic heat-exchanging device comprising one or more fine capillary metallic tubelets for further cooling oxygen delivered to a user of the generator 10 to avoid user injury, for example by way of scorching the user's lung cilia.

Figure 3:
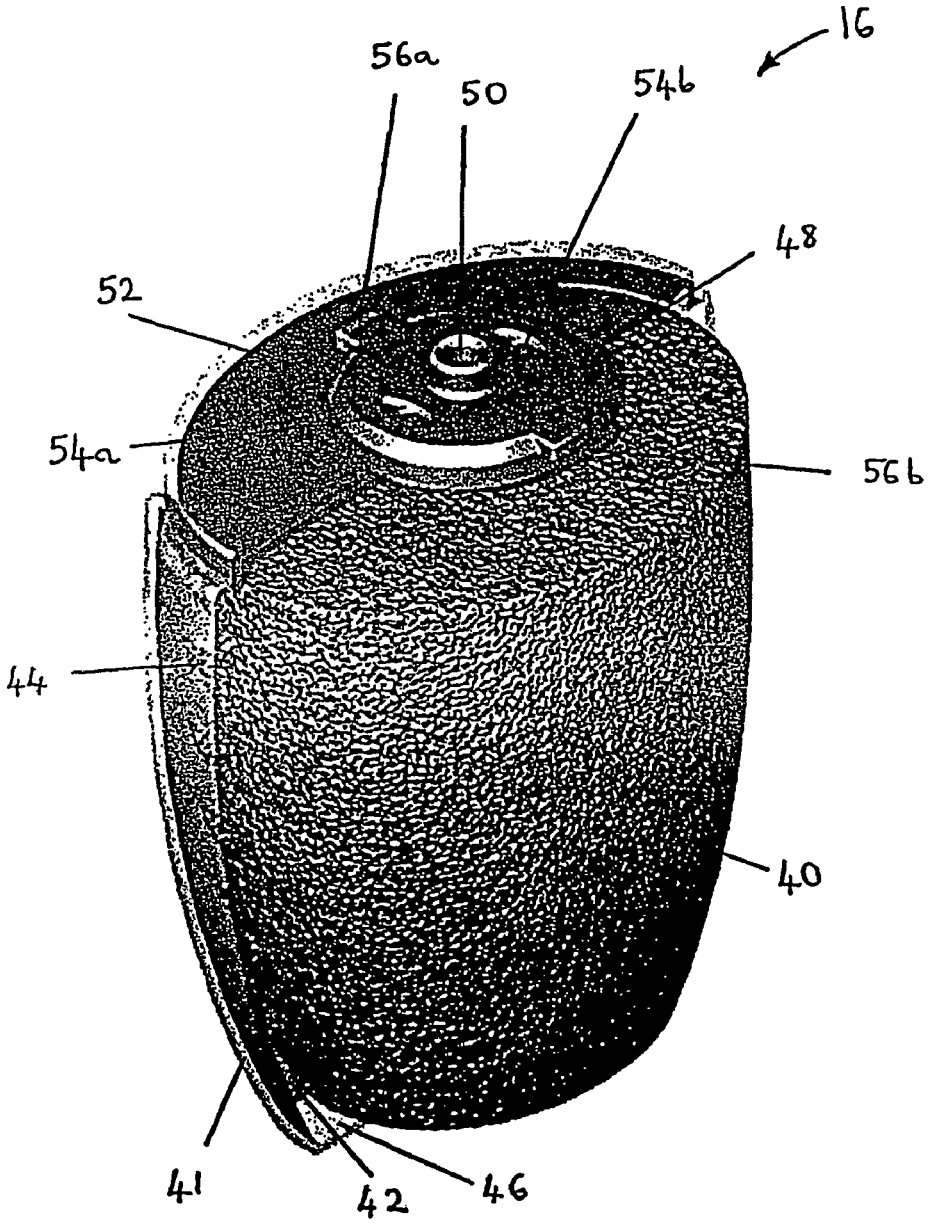
FIG. 3 is a cutaway view of the generating unit including a spiral oxygen-cooling path and a thermal insulator.

The generating unit 16 will now be described in greater detail with reference to FIG. 3.

The unit 16 comprises an outer casing 41 housing an insulator 40 of substantially hollow cylindrical form. The insulator 40 preferably has a lateral wall thickness in a range of 20 mm to 40 mm. More preferably, it has a wall thickness in a range of 25 mm to 30 mm. The insulator 40 is supported within the casing 41 by way of inwardly-facing projections, for example a projection 42, moulded into the casing 41. As an alternative to moulding the projections into the casing 41, the projections can be formed as a separate helical insert which is inserted between the casing 41 and the insulator 40 during manufacturing assembly. The projections define a peripheral path 44 by which oxygen gas emitted at a base region of the insulator 40 into a lower cavity 46 can propagate to an upper cavity 48 and therefrom via a centrally-disposed orifice 50 into the cap 12. The unit 16 further includes a raised central connection shoe 52 comprising the orifice 50, lateral projections 56*a*, 56*b* for co-operating with corresponding coarse thread or bayonet-type features in the cap 12 for twistably locking the unit 16 to the cap 12 in use, and two electrical contacts 54*a*, 54*b* by which an electrical connection is made between the cap 12 and the unit 16 for initiating the chemical reaction within the unit 16.

The path 44 can be implemented in a plurality of different geometries which will be described in greater detail later.

In operation, oxygen ejected at the base of the insulator 40 is at an elevated temperature of at least 150° C. As the oxygen passes along the path 44, it is cooled to a temperature in the order of 50° C. The oxygen is finally emitted through the orifice 50 at this temperature. In the cap 12, further cooling occurs in the blender therein so that the oxygen-enriched air delivered to the user via the headset 22 is only a few degrees centigrade at most above ambient temperature. The casing 41 also provides an additional benefit in that it prevents the user from touching the insulator 40 whose peripheral exterior surface can attain surface temperatures in the order of 30° C. above ambient temperature when in operation.

The tube 20 preferably includes the aforesaid metallic heat-exchanging device for further cooling the oxygen delivered to the headset 22.

Figure 4:
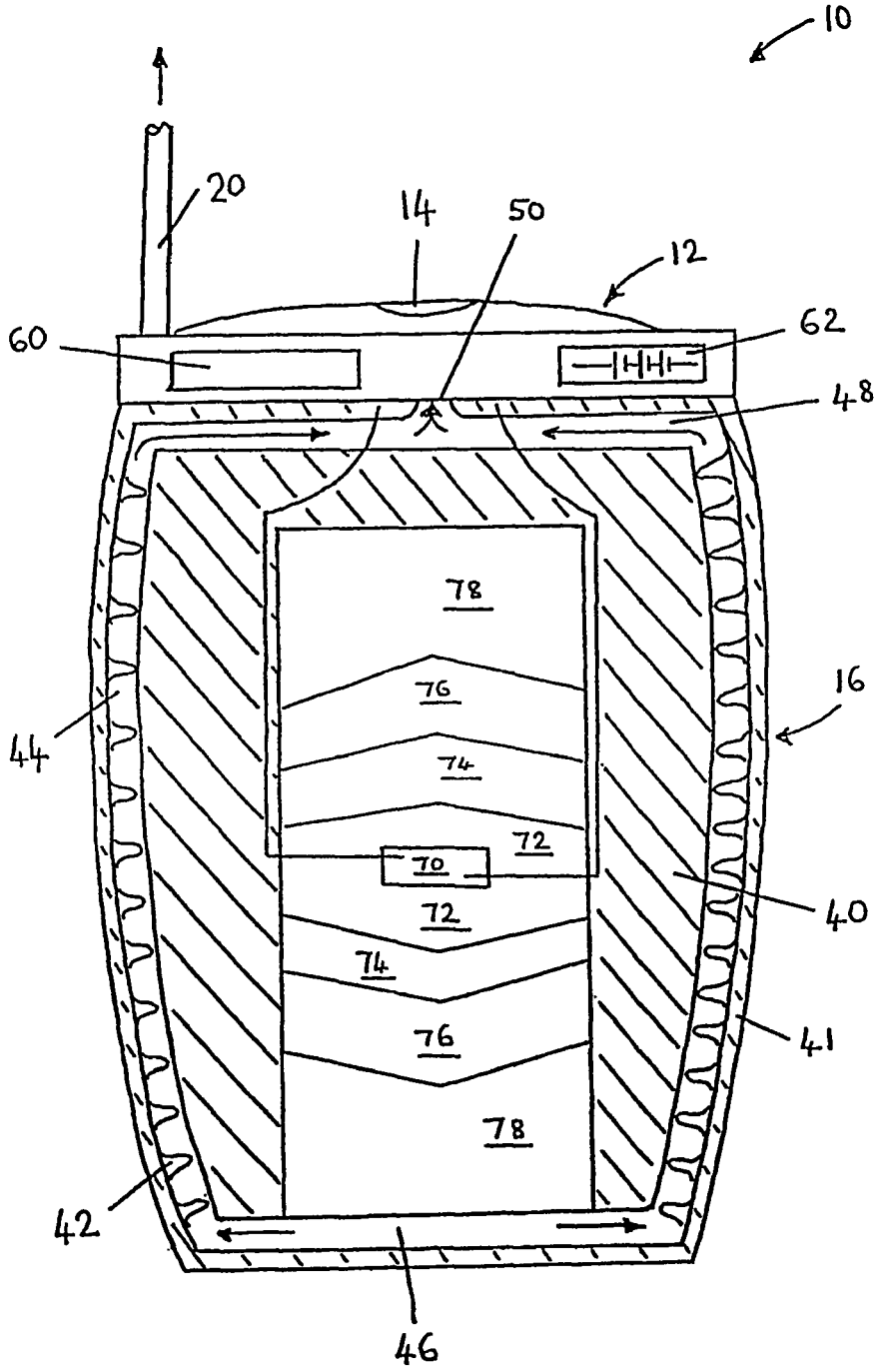
FIG. 4 is a cross-sectional view of the generator along an axis A-B in FIG. 1.

Construction of the unit 16 is illustrated in further detail in FIG. 4 which is a cross-sectional view along an axis A-B in FIG. 1.

The cap 12 comprises an electronic unit 60 and an electrical battery 62. The battery 62 is preferably one or more of an alkaline battery, a lithium manganese battery and a manganese zinc battery. Moreover, the battery 62 is of sufficient capacity to render it capable of igniting several generating units 16 before becoming exhausted. The electronic unit 60 performs two functions in operation, namely it provides an indication of the condition of the battery 62 and also supplies electrical power from the battery 62 to the generating unit 16 when the ignition button 14 is depressed. The aforesaid blender is not shown included in FIG. 4.

The insulator 40 is preferably fabricated from a microporous insulating material having a density in a range of 150 to 400 kg/m$^3$. Such an insulating material is available from Thermal Ceramics Ltd. who manufactures under licence from Schuller International Inc. Schuller International has U.S. Pat. Nos. 5,703,147 and 4,921,894 concerning the manufacture of such insulating material, these two patents being incorporated herein by reference.

Alternatively, or in addition to using the microporous insulating material, the insulator 40 can comprise one or more of ceramic alumina pellets, glass pellets, calcined clay pellets and silica pellets. Glass is substantially fused silicon dioxide. Such ceramic alumina is capable of withstanding temperatures of up to 2300° C. without decomposing. Moreover, such ceramic alumina is a relatively good thermal insulator, voids between the pellets serving to as a further thermal break to reduce heat transfer. The pellets are preferably substantially spherical.

The insulator 40 comprises a hollow interior region in which an oxygen generating candle is housed together with an ignition device 70. The device 70 is connected by two wires to the two electrical contacts 54*a*, 54*b* as illustrated. The candle comprises predominantly a metal chlorate together with fuel additives to enhance its combustion.

The candle is of a substantially symmetrical form and is segregated into a plurality of stages, namely an ignition stage 72, two booster stages 74, two intermediate stages 76 and two main body stages 78 as illustrated. The stages 72, 74, 76 78 are configured to mutually abut by way of conical interfaces as illustrated. It will however be appreciated that other interface profiles can be employed, for example stepped or frustro-conical interface profiles.

The ignition device 70 is incorporated at a substantially central location within the candle. The stages 72, 74, 76, 78 are arranged symmetrically along the axis A-B from the device 70. The ignition stage 72 is closest to the device 70 whereas the main body stages 78 are most remote therefrom.

Combustion initiation within the ignition stage 72 requires relatively little thermal input in comparison to the main body stages 78. The ignition stage 72 is thus more chemically active, namely less chemically inert on account of its relatively higher fuel content, e.g. metallic iron, or magnesium, relative to its metal chlorate content In contradistinction, the main body stages 78 are more chemically inert on account of their relatively lower iron fuel content relative to their metal chlorate content. Thus, the stages 72, 74, 76, 78 are progressively more inert spatially away from the device 70. Such a configuration of stages is employed because an inconveniently large thermal input would be required from the device 70 to ignite the main body stages 78 if they abutted directly onto the device 70 with the ignition, booster and intermediate stages 72, 74, 76 omitted.

The stages 72, 74, 76, 78 can comprise one or more of compressed powdered material and compressed pelletised material. Thus, the stages 72, 74, 76, 78 are preferably cast or loose-filled during manufacture.

One or more of the stages 72, 74, 76, 78 preferably comprise compressed components in the form of ring-like or disc-like units which are stacked together during manufacture to form the candle.

As the candle tends to burn more rapidly downwards than upwards, assuming that the generator 10 is deployed in an upright position during use with the cap 12 uppermost, and the oxygen outlet cavity 46 is at the base of the generator, the stages 74, 76, 78 nearer the cap 12 preferably have an enriched iron fuel content therein compared to the stages 74, 76, 78 more remote from the cap 12. Alternatively, the length of the stages 74, 76, 78 nearest the cap 12 can be made shorter relative to the stages 74, 76, 78 more remote from the cap 12.

The ignition device 70 is preferably a resistive element which glows to red/white heat, namely acquires a temperature in the order of at least 1500° C., when a current in a range of 4 to 5 Amperes is passed therethrough for a few seconds. Excessive current passed through the device 70 renders it susceptible to burning out before ignition within the candle occurs. Conversely, insufficient current results in unsuccessful ignition of the candle and wastes electrical energy from the battery 62; such unsuccessful ignition can result in ignition stage 72 material immediately adjacent to the device 70 being partially combusted making subsequent re-ignition of the candle problematical or impossible.

The device 70 is conveniently a compact commercially available glowplug adapted for initiating combustion in miniature diesel engines, for example in miniature aero-engines. However, other implementations of the device 70 are feasible, for example a thin film resistive element formed on a ceramic substrate, a hot wire device, and a miniature explosive device as used in flares and automobile air-bag systems. The hot wire device is of advantage in that it is intrinsically safe, for example in storage, until a sufficient voltage is applied across it. Moreover, the hot wire device does not release potentially harmful fumes when the candle is ignited as can potentially occur when chemical detonator devices are employed; thus, a purer oxygen supply can be achieved when the hot wire device is employed.

Operation of the oxygen generator 10 will now be described with reference to FIG. 4.

When activating the generator 10, a user thereof depresses the ignition button 14 which connects the battery 62 to the device 70 for a few seconds causing it to glow at red/white heat. Such red/white heat ignites the ignition stage 72 which commences to burn releasing oxygen. There is thereby created two burn fronts which propagate in generally mutually opposite directions substantially parallel to the A-B axis through the ignition stage 72 towards the intermediate stages 74.

The general temperature within the insulator 40 steadily rises as the burn fronts propagate to and through the booster stages 74 and then through the intermediate stages 76 to reach eventually the main body stages 78. When the burn fronts reach extreme end faces of the main body regions 78, combustion within the candle ceases.

Oxygen gas released during combustion of the stages 72, 74, 76, 78 passes through the insulation 40 into the lower cavity 46 and then into the peripheral path 44 wherein the gas is cooled to a temperature of around 30° C. above ambient temperature surrounding the generating unit 16. The cooled gas finally exits from the path 44 and enters into the upper cavity 48 wherein the gas is directed through the orifice 50 into the cap 12. The cooled gas is blended with ambient air in the cap 12 and then directed through the tube 20 to the headset 22 and hence to the user for inhalation. Such blending further cools the cooled gas supplied to the cap 12 via the orifice 50. The aforesaid metallic heat-exchanging device can be included in-line with the tube 20 or be included as part of the headset 22 when additional oxygen cooling is required.

It is found that the frusto-conical interfaces illustrated in FIG. 4 are especially beneficial for ensuring the burn fronts progress efficiently from one stage to the next. Moreover, an outside surface of the insulator 40 facing towards the casing 41 is preferably metallized to reflect heat back towards the stages 72, 74, 76, 78. Furthermore, an inside surface of the insulator 40 facing towards the stages 72, 74, 76, 78 is also preferably metallized to reflect heat back and thereby reduce the operating temperature of the casing 41. Suitable metallization materials include one or more of aluminium, titanium or chromium, although chromium is especially preferred because it is capable of withstanding exposure to high temperatures in the order of 1200° C.

Several benefits arise from employing the symmetrical arrangement of stages 72, 74, 76, 78 illustrated in FIG. 4. Two burn fronts propagate within the generating unit 16 providing the benefit that heat is less concentrated within the stages 72, 74, 76, 78 compared to a generating unit of asymmetrical configuration employing only a single burn front. Such reduced heat concentration eases thermal management issues within the generating unit 16; for example, by employing the symmetrical arrangement, most heat generated when the ignition stage 72 ignites is remote from cap 12. Highest local temperatures within the candle are attained at the commencement of burning therein. Moreover, the use of two burn fronts can be used to tailor temporal oxygen delivery rates provided by the generator 10. In this respect, an initial oxygen surge occurs when the ignition stage 72 is activated; including two main body sections 78 assists to ensure that oxygen delivery late in the candle burn arises from two burn fronts, therefore more closely matching the initial oxygen surge and hence providing a more uniform temporal oxygen delivery characteristic.

Although the use of four types of stage is described above, it will be appreciated that more or less than four stages is also feasible.

Figure 5:
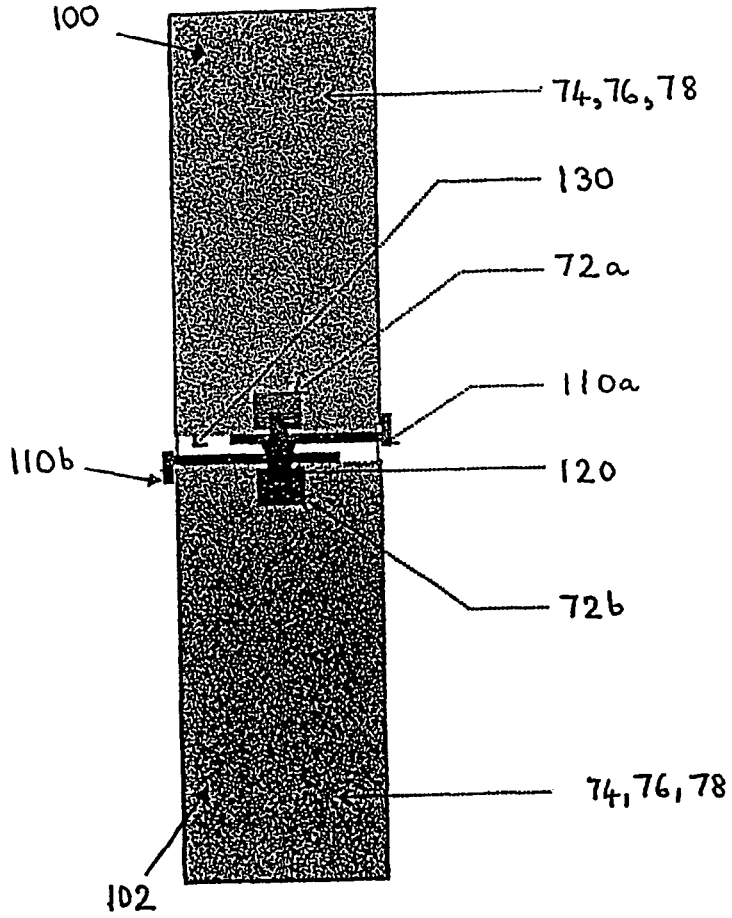
FIG. 5 is a first oxygen-generating candle configuration for the generator, the candle having lateral electrical contacts.

Implementation of the candle in FIG. 4 will now be described in more detail with reference to FIG. 5. The candle is constructed in upper and lower sections 100, 102 respectively with the device 70 and its associated electrical connections 110*a*, 110*b* housed at inside facing surfaces of the sections 100, 102. The device 70 comprises a glowplug 120 having its two ends embedded in the ignition stage 72 implemented as two stagelets 72*a*, 72*b*. A central region 130 between the two sections 100, 102 comprises a ring of oxygen producing mix devoid of an iron fuel component, such a mix being substantially non-electrically conducting and therefore reducing a risk of an electrical short occurring between wires conveying power to the device 70. Wires are connected from the connections 110*a*, 110*b* to the electrical contacts 54*a*, 54*b*. The wires are preferably insulated with a material which is unsusceptible to releasing toxic gases when combusted, for example an alumina ceramic or glass insulating material implemented as beads bearing holes therein through which electrical wires can be threaded. Electrical connection to the connections 110*a*, 110*b* is preferably made using metal conducting brushes. The contacts 54*a*, 54*b* are preferably implemented in one or more of a variety of shapes from quadrant form to full circle form.

Figure 6:
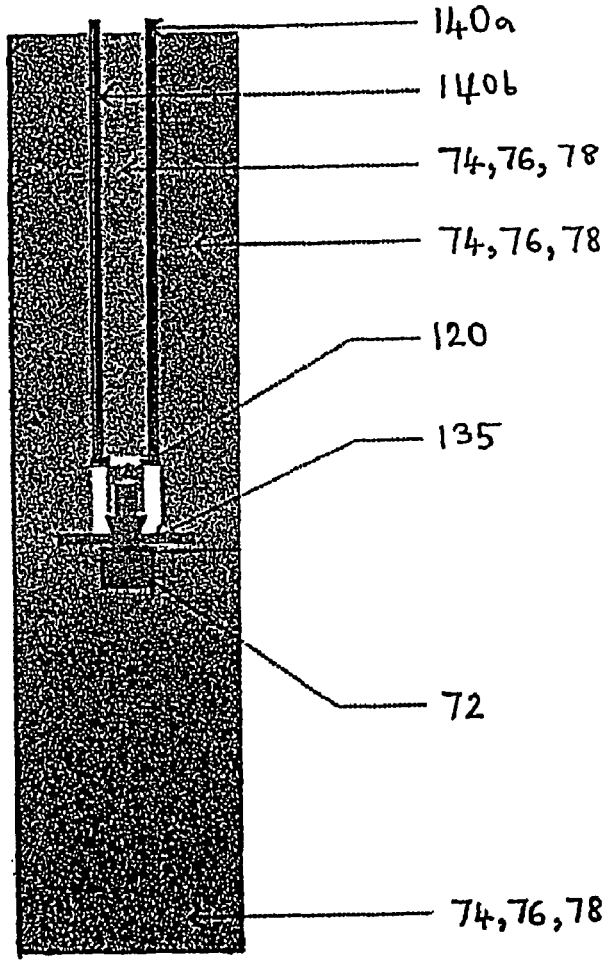
FIG. 6 is a second oxygen-generating candle configuration for the generator, the candle having substantially axial electrical contacts.

FIG. 6 is an illustration of an alternative implementation of the candle. As before, the ignition device 70 comprises the glowplug 120 which is mounted onto a retaining washer 135. A lower end of the glowplug 120 is embedded into the ignition stage 72. Electrical connections 140*a*, 140*b* are conveyed substantially axially from the electrical contacts 54*a*, 54*b* to the glowplug 120.

For safety reasons, in view of candle internal burn temperatures being in the order of 1000° C., it is desirable for the generating unit 16 to be tamper-proof and not susceptible to ignition when disconnected from the cap 12. Thus, as an alternative to the electrical contacts 54*a*, 54*b*, the cap 12 can be modified to couple electrical power inductively into the device 70. Such inductive coupling requires the use of drive and pickup coils within the generator 10.

Figure 7:
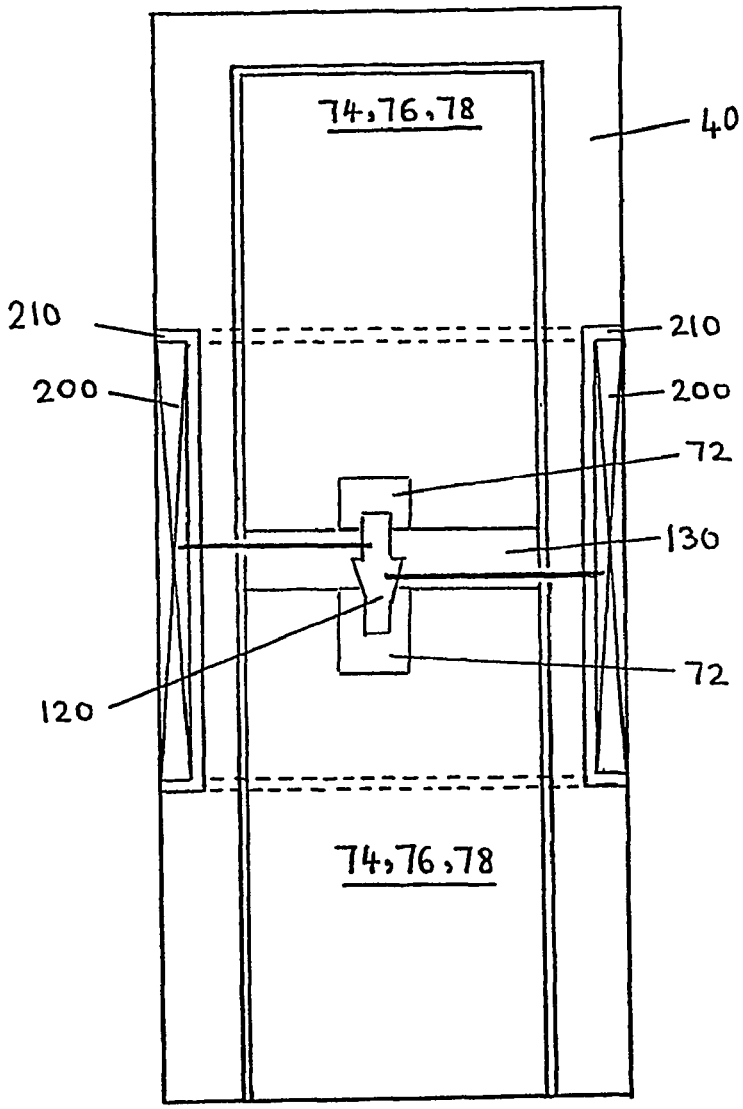
FIG. 7 is a third oxygen-generating candle configuration for the generator, the candle having a centrally-disposed inductive coupling coil.

In FIG. 7, the glowplug 120 is connected to an annular pickup coil 200 included around a central peripheral region of the candle as illustrated. The coil 200 is preferably provided with a ferromagnetic core 210 to assist with concentrating magnetic flux when coupling to the drive coil (not shown) included within the cap 12 or a projection from the cap 12 extending substantially to encircle the central peripheral region of the candle when the generating unit 16 is engaged onto the cap 12. The benefit of employing inductive coupling is that it is not necessary to ensure good electrical contact from the cap 12 to the generating unit 16; poor connection through the contacts 54*a*, 54*b* potentially arises where the generator 10 is stored for prolonged conditions in damp conditions where contact oxidation can occur.

Figure 8:
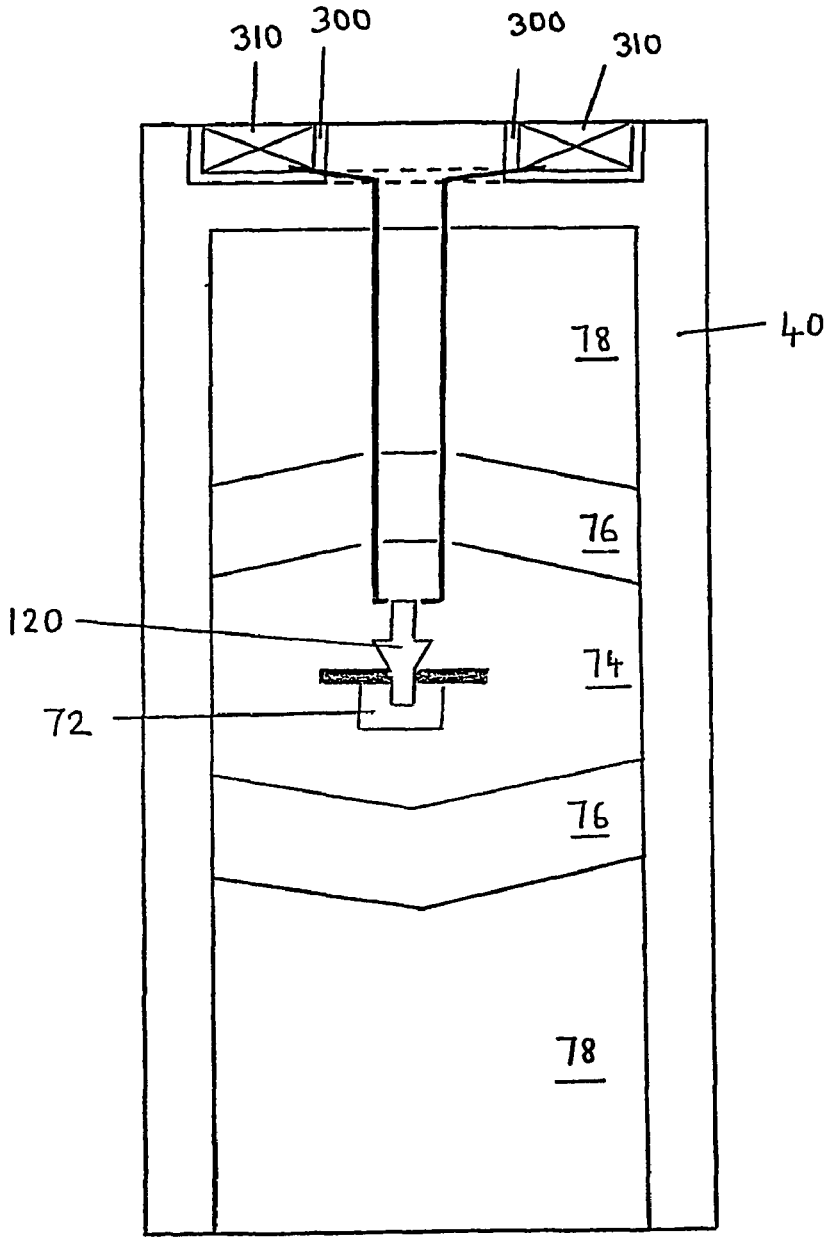
FIG. 8 is a fourth oxygen-generating candle configuration for the generator, the candle having an end-disposed inductive coupling coil.

As an alternative to mounting the pickup coil 120 at a central peripheral region, the candle can be modified as illustrated in FIG. 8. The candle here has its annular pickup coil 310 and associated complementary annular ferro-magnetic core 300 included at an extreme end of the candle which would, in use, be in closest proximity to the cap 12. Electrical conductors from the coil 310 are conveyed substantially axially through the insulator 40 to the glowplug 120.

Figure 9:
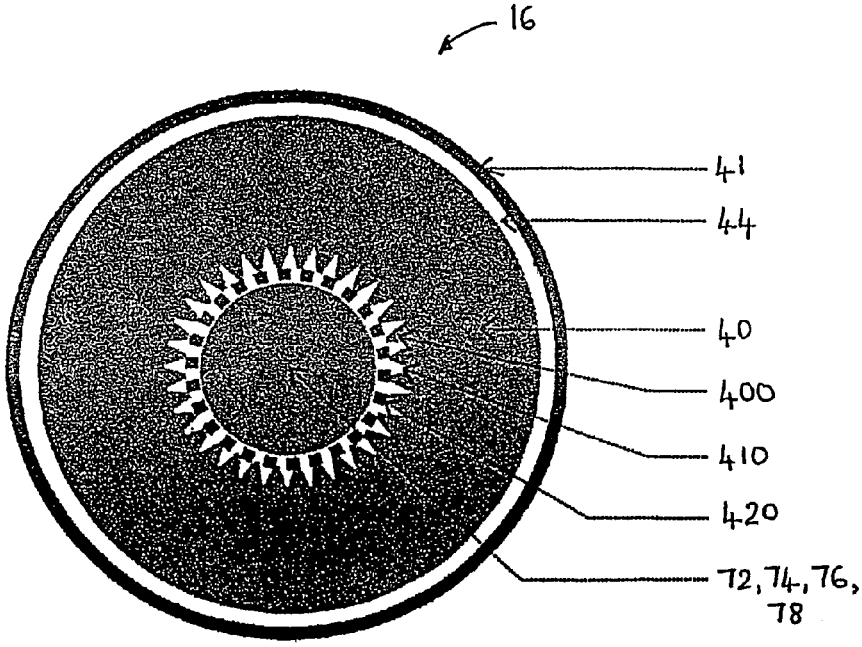
FIG. 9 is a cross-sectional view along an axis C-D in FIG. 1 illustrating interior features of the oxygen-generating candle.

The insulator 40 is preferably a moulded or extruded component. The insulator 40 can be implemented with varying interior-facing and exterior-facing surface profiles. For example, in FIG. 9, the insulator 40 comprises inside fluted projections 400 defining adjacent voids 410 therebetween. The voids 410 provide a path by which oxygen emitted from the candle can pass to the lower cavity 46. Such fluted projections provide a minimum contact area between the insulator 40 via a perforated metal support 410 to the candle. The metal support 410 is preferably fabricated from brass or copper which, when heated, is capable of removing chlorine impurities in oxygen generated within the candle. The metal support 410 is also of advantage in that it conducts thermal energy away from burning regions within the candle thereby preheating regions of the candle soon to combust. The exterior facing surface of the insulator 40 is illustrated as being smooth and devoid of projections, the path 44 being defined by inwardly-facing projections formed into the casing 41.

Figure 10:
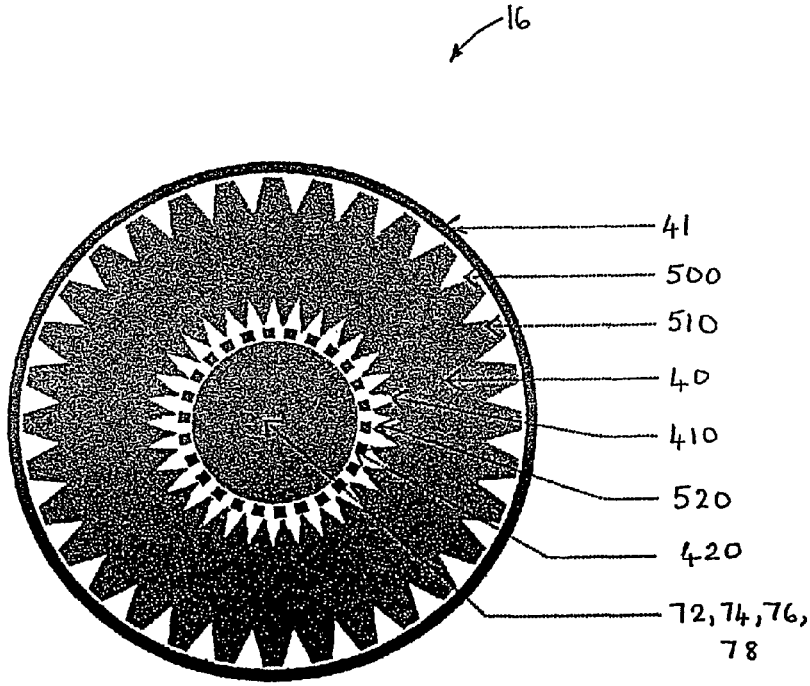
FIG. 10 is a cross-sectional view along the axis C-D illustrating first alternative interior features of the candle.

Alternatively, as illustrated in FIG. 10, the exterior facing surface of the insulator 40 is provided with fluted projections 510 defining voids 500 for providing a plurality of paths from the lower cavity 46 to the upper cavity 48, thereby avoiding the need for the casing 41 to comprise inwardly-facing projections. The inside-facing surface of the insulator 40 preferably also includes projections defining voids 410. More preferably, an air gap exists between the projections and the metal support 420 to reduce thermal conductivity from the candle to the insulator 40 and provide a path by which oxygen gas emitted from the candle can propagate to the lower chamber 46.

Figure 11:
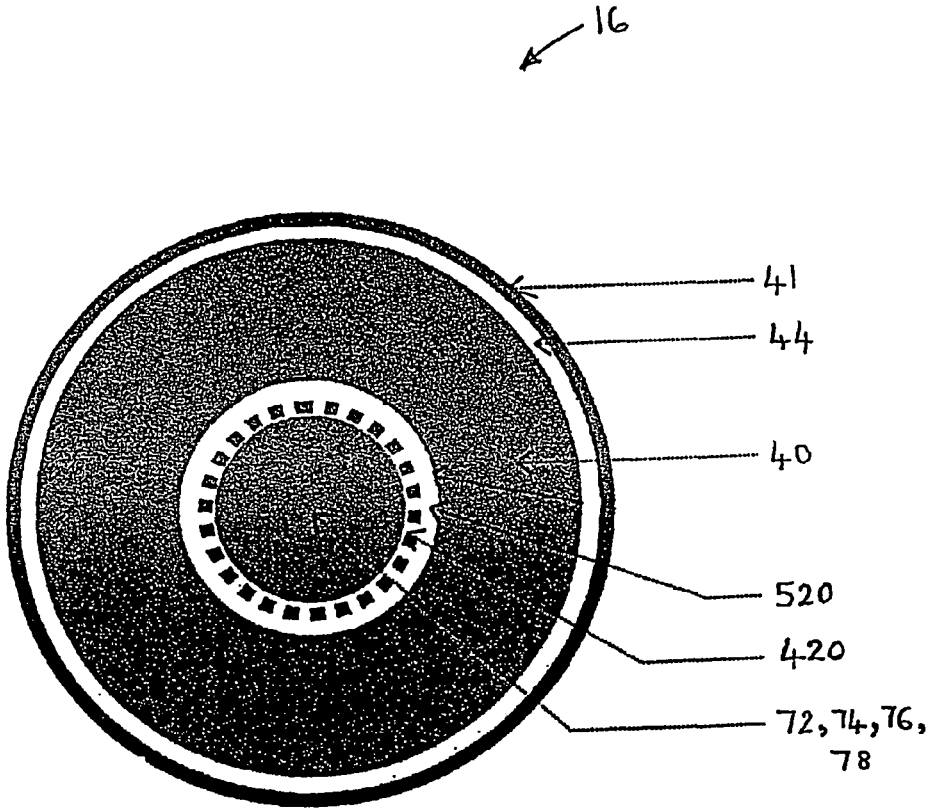
FIG. 11 is a cross-sectional view along the axis C-D illustrating second alternative interior features of the candle.

As a further alternative, both the interior-facing and exterior-facing surfaces of the insulator 40 are substantially devoid of projections as illustrated in FIG. 11. However, a few projections will be required to maintain the candle spatially concentric within the insulator 40.

Figure 12:
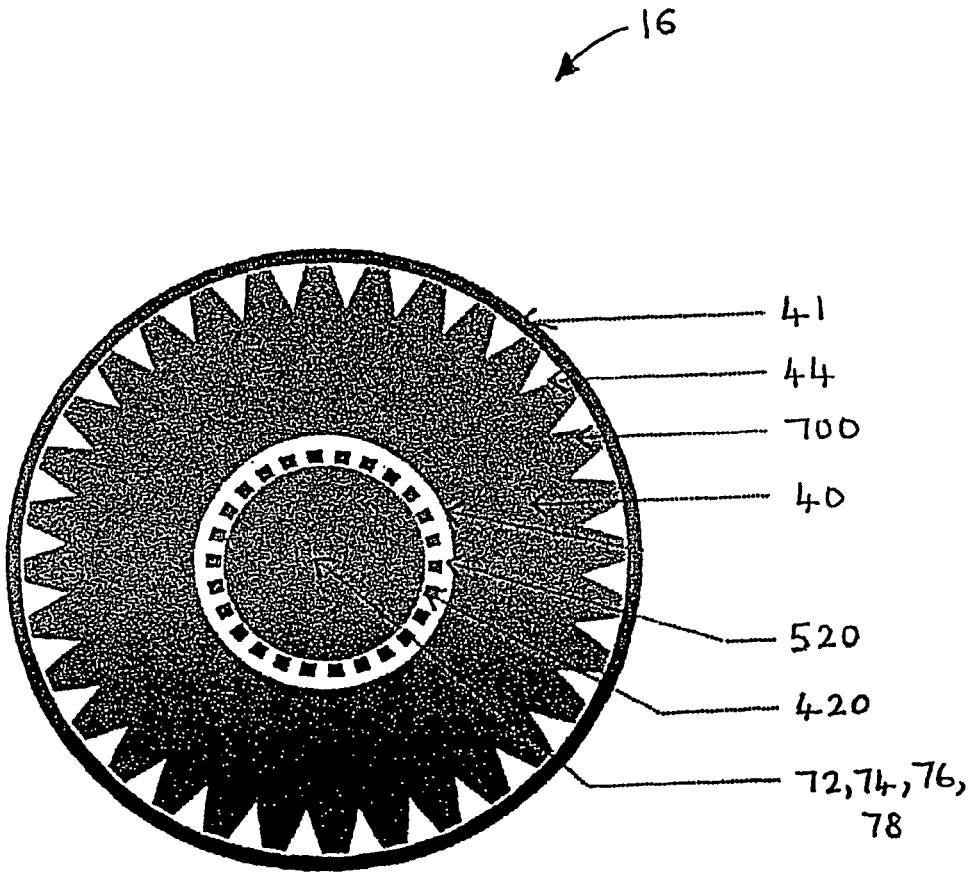
FIG. 12 is a cross-sectional view along the axis C-D illustrating third alternative interior features of the candle.

As a yet further alternative, as illustrated in FIG. 12, the interior-facing surface of the insulator 40 is substantially devoid of projections whereas the exterior-facing surface of the insulator 40 includes radial projections 700 defining voids therebetween providing a plurality of oxygen gas cooling paths from the lower cavity 46 to the upper cavity 48.

Figure 13:
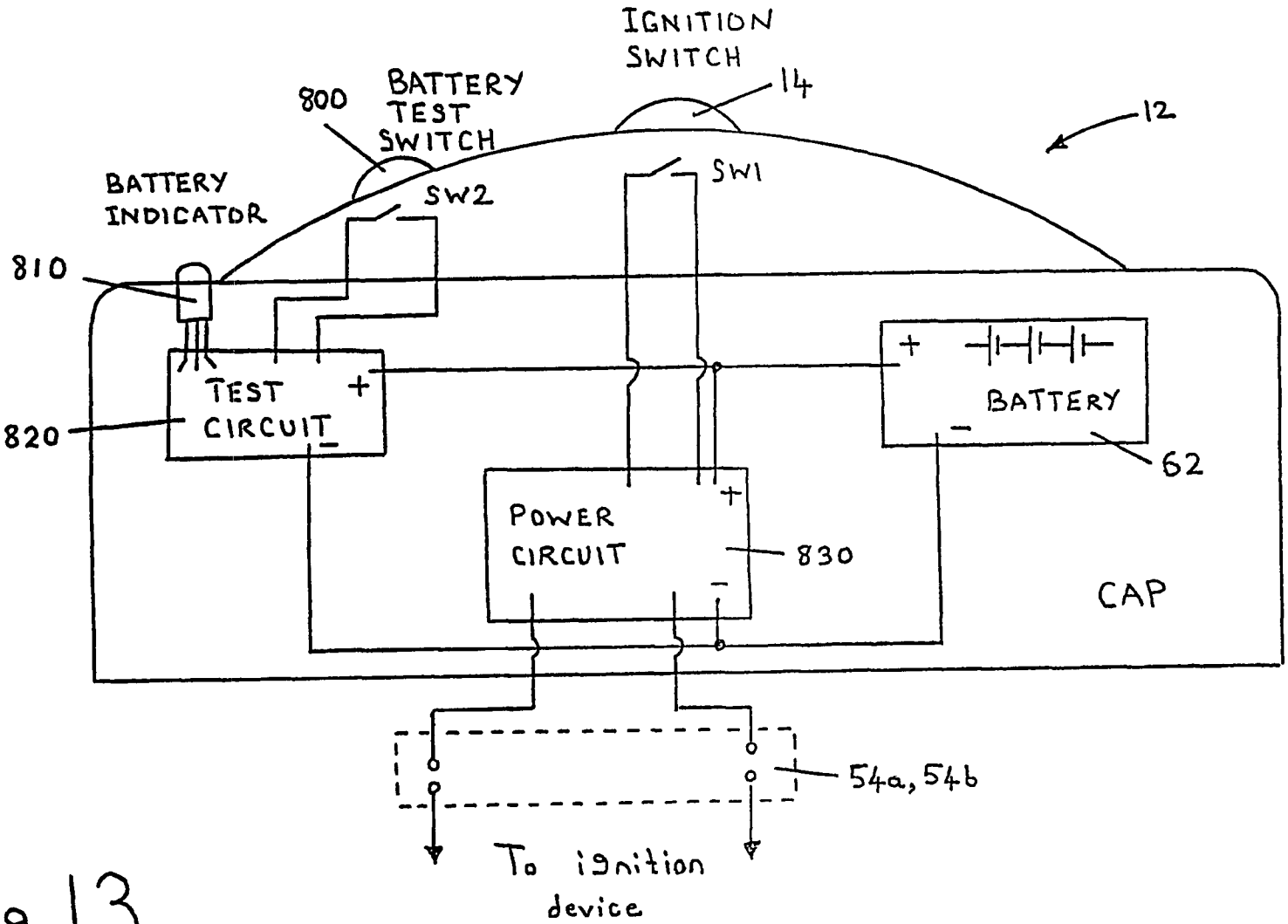
FIG. 13 is a schematic illustration of an electronic unit included within the cap of the generator.

The cap 12 together with the electronic unit 60 will now be described in more detail with reference to FIG. 13. The cap 12 comprises the battery 62, the ignition button 14 and its associated switch SW1, a battery test button 800 and its associated switch SW2, a battery indicator 810, a battery test circuit 820 and a power control circuit 830. The test circuit 820 is connected to the battery 62, to the switch SW2 and to the indicator 810. The indicator 810 is preferably a three terminal light emitting diode (LED) device which is capable of emitting red light to indicate when the battery 62 needs replacing, and of emitting green light when the battery 62 is providing a sufficiently high output voltage for it to be capable of igniting the candle when the ignition button 14 is depressed. A liquid crystal display (LCD) indicator can be included in substitution for or in addition to the indicator 810; employing both types of indicator is advantageous in some situations because LEDs are more visible in dark conditions whereas LCD are more visible in bright sunlight, for example on a mountain top susceptible to elevated ultra-violet radiation exposure.

Likewise, the power circuit 830 is connected to the battery 62, to the switch SW1 and via the contacts 54*a*, 54*b* to the ignition device 70 within the candle. When inductive coupling is employed, the contacts 54*a*, 54*b* are omitted and a drive coil (not shown) included in substitution.

Figure 15:
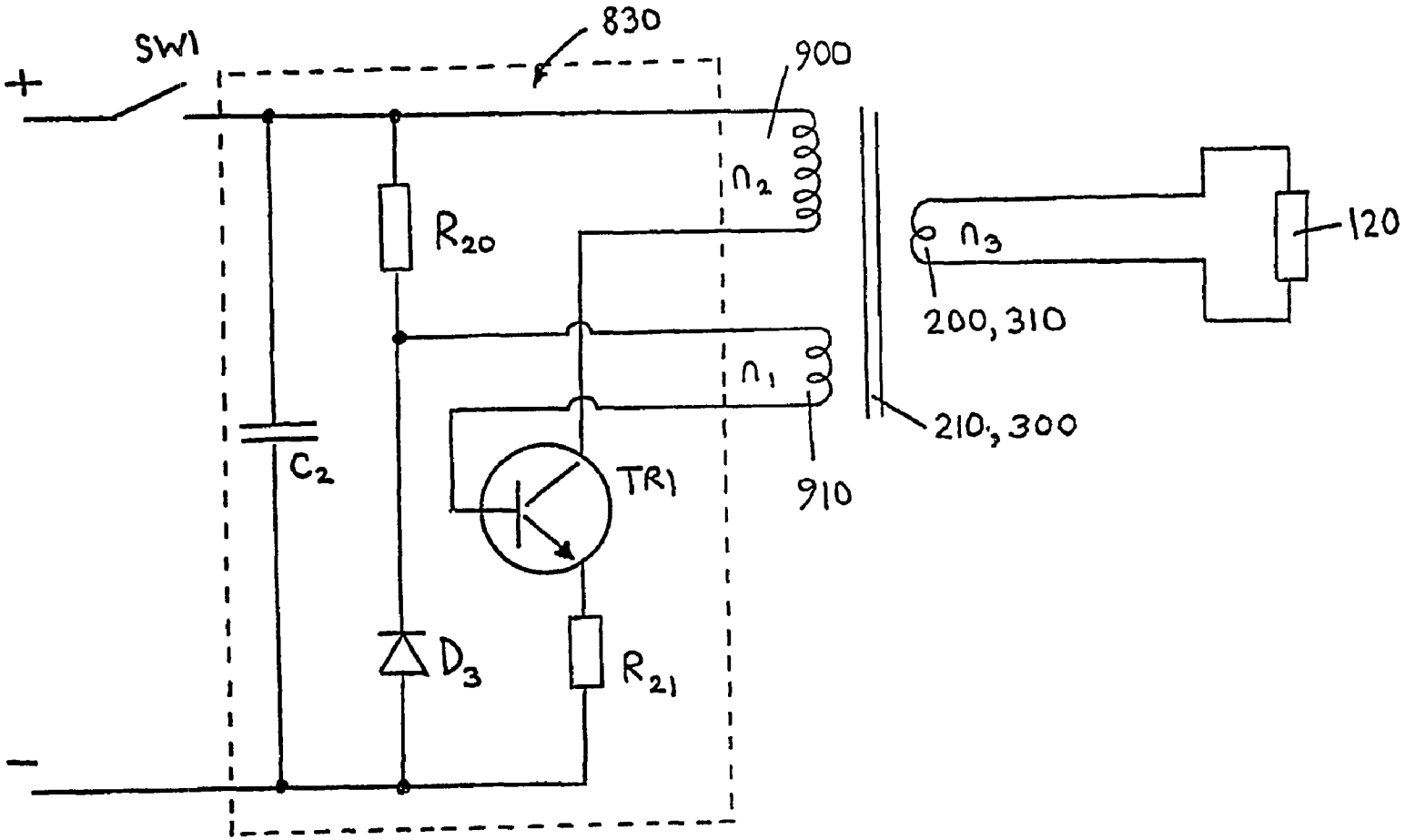
FIG. 15 is a schematic diagram of a blocking oscillator circuit for providing an alternating signal for use when ignition power is inductively coupled into the candle.
Figure 16:
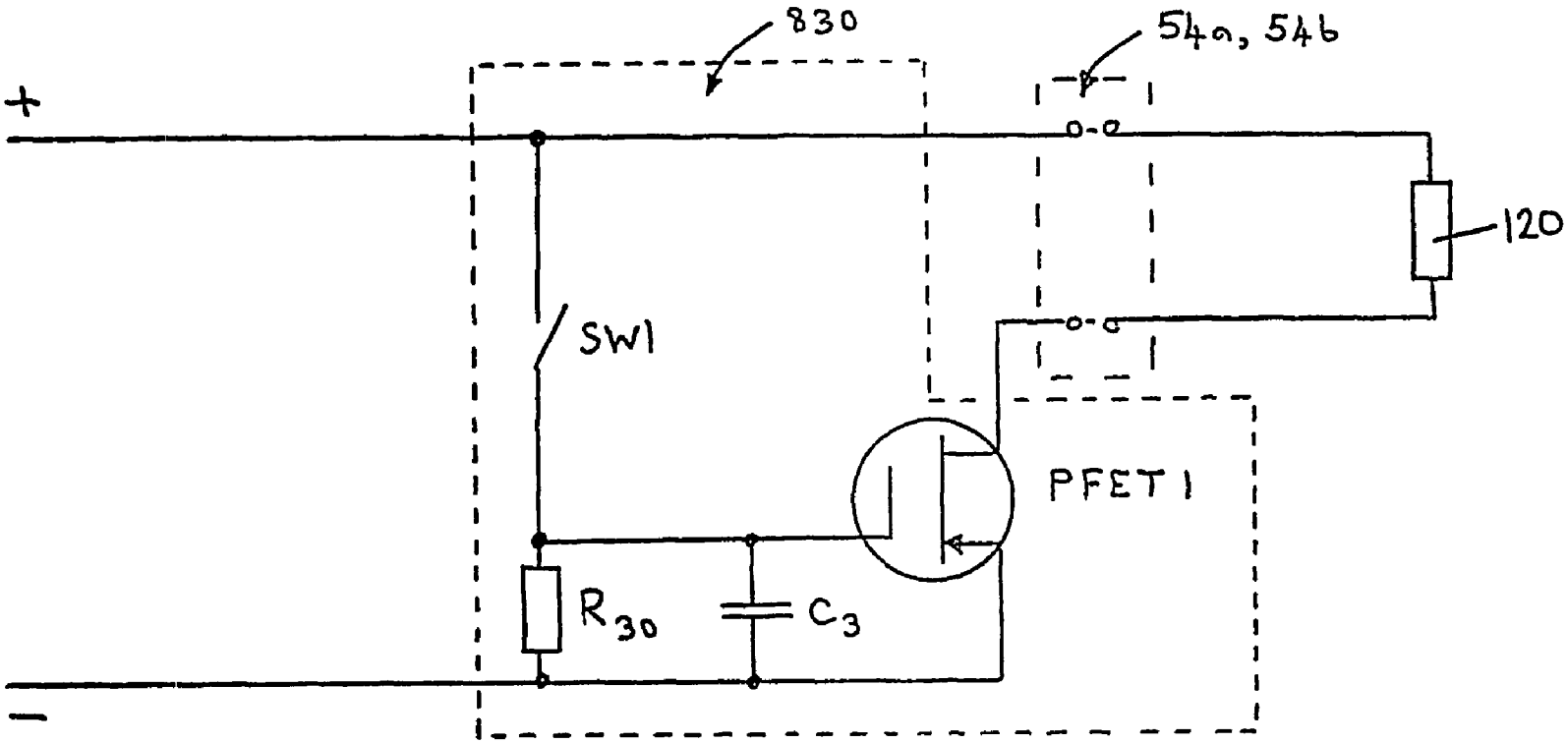
FIG. 16 is a schematic diagram of a power control circuit of the electronic unit for providing electronically switched current for igniting the candle.

In its simplest form, the battery 62 is connected in series via the switch SW1 to the ignition device 70 such that the control circuit 830 is a mere through-connection; such a form for the ignition circuit 830 corresponds to simple electrical ignition for the generator 10. In a more sophisticated version of the cap 12, the control circuit 830 includes an electronic power switching device as illustrated in FIG. 16 for electronically timing a period in which power is applied to the ignition device 70, thereby achieving reliable ignition and assisting to conserve energy within the battery 62; such a form for the ignition circuit 830 corresponds to electronic ignition for the generator 10. In an inductively coupled version of the cap 12, the power circuit 830 includes a blocking oscillator, for example as illustrated in FIG. 15, for generating an alternating signal suitable for driving the aforementioned drive coil; again, such a form for the ignition circuit corresponds to electronic ignition for the generator 10.

The electronic unit 60 is preferably fabricated as a single circuit board including surface-mounted components and housed within a recess moulded into the cap 12.

Figure 14:
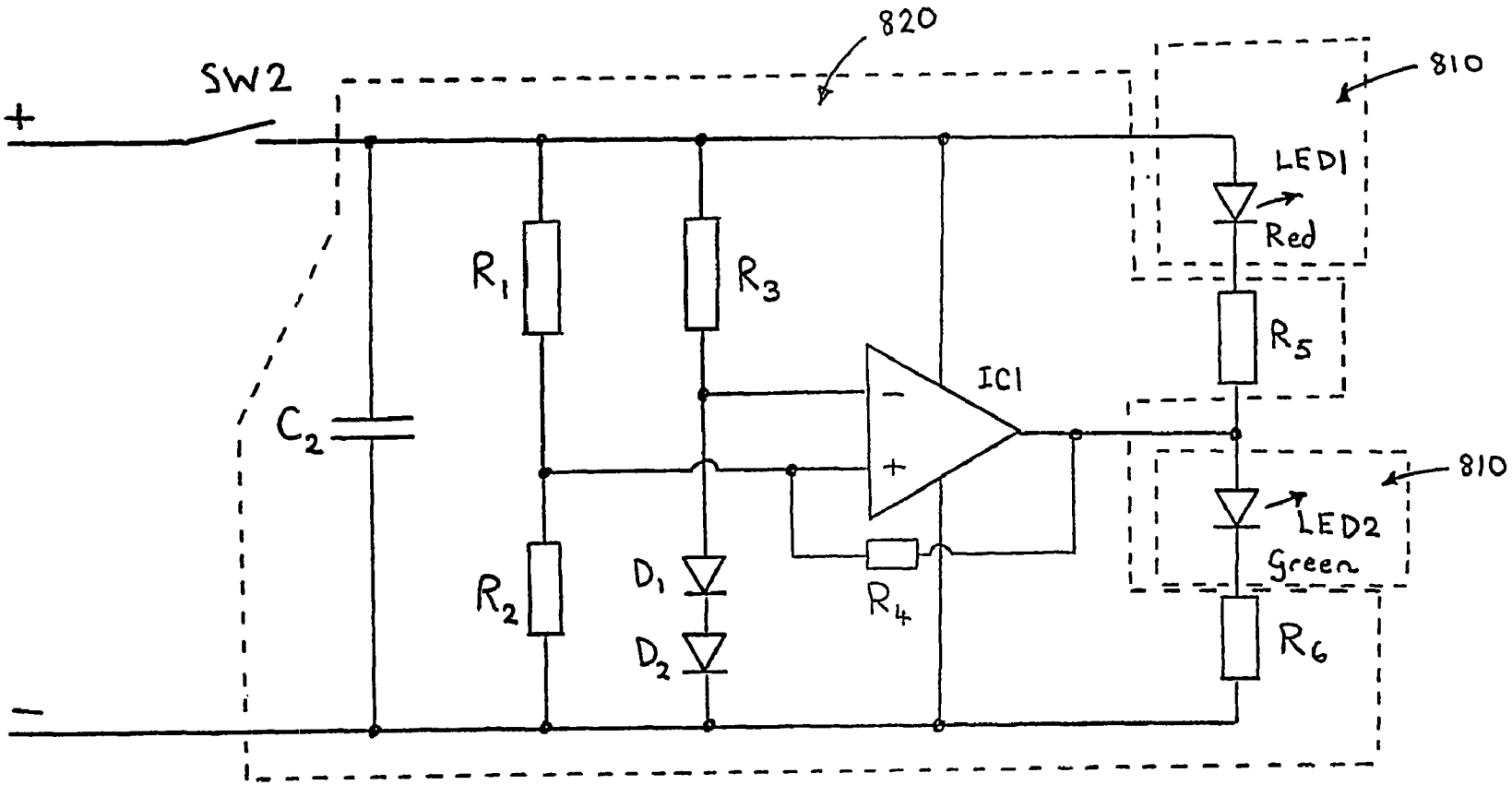
FIG. 14 is a schematic diagram of a battery test circuit of the electronic unit.

In FIG. 14, the battery test circuit 820 is illustrated in more detail. The circuit 820 comprises a voltage comparator IC1, for example a comparator of LM339-type which is capable of sensing potential differences close to or at its supply potentials. A non-inverting (+) input of the comparator IC1 is connected to a midpoint of two resistors $R_1$ and $R_2$ connected to positive (+) and negative (−) supply potentials respectively provided from the battery 62. An inverting (−) input of the comparator IC1 is connected to a midpoint of a resistor $R_3$ in series with two diodes $D_1$, $D_2$ providing a reference voltage of substantially 1.2v above the negative supply potential (−) from the battery 62. A feedback resistor $R_4$ is connected from an output of the comparator IC1 to the non-inverting (+) input to provide the circuit 820 with a degree of sensing hysteresis to assist the circuit 820 to function reliably when the battery 62 is approaching its exhausted state. LEDs of the indicator 810 are connected in series with associated current-limiting resistors $R_5$, $R_6$ as illustrated. An output of the comparator IC1 is connected to a midpoint of the series-connected LEDs as shown.

In operation, the user momentarily depresses the button 800 which energises the circuit 820, the circuit 820 causing the red LED1 to illuminate if the battery 62 is exhausted or the green LED2 to illuminate if the battery 62 has sufficient capacity remaining to operate the generator 10.

The circuit 820 is of advantage in that it does not consume power when the button 800 is not depressed by the user. Moreover, the circuit 820 can be implemented using relatively inexpensive components.

Referring next to FIG. 15, the control circuit 830 is illustrated having a form appropriate when inductively coupling power to the ignition device 70. The circuit 830 comprises a supply bypass capacitor $C_2$, a bi-polar power transistor TR1 together with its associated current-limiting emitter resistor $R_{21}$, a biasing network comprising a resistor $R_{20}$ and a diode $D_3$ for biasing the transistor TR1. The circuit 830 is connected to first and second windings 900, 910 respectively constituting the aforesaid drive coil.

In operation, the user depresses the button 14 which activates the switch SW1 to apply power to the circuit 830. On account of positive feedback from the first winding 900 to the second winding 910, the transistor TR1 spontaneously oscillates at a frequency of several ten's of kHz, thereby creating a cyclically varying magnetic flux in the core 210, 300 and thereby coupling energy into the receiving coil 200, 310 for heating the glowplug 120.

The circuit 830 illustrated in FIG. 15 is of advantage in that it does not consume power when the button 14 is not depressed and circumvents the need for the electrical contacts 54*a*, 54*b* which are potentially prone to oxidation and hence unreliability after prolonged periods of storage in damp environments. Moreover, use of inductive coupling reduces a risk of users tampering with the generating unit 16 and causing it to ignite when not engaged onto the cap 12. Furthermore, by making the number of turns $n_2$ on the first coil 900 relatively large relative to the number of turns $n_3$ on the coils 200, 310, a transformer step-down effect can be achieved capable of delivering substantial current to the device 70.

As described earlier, application of power to the glowplug 120 for a timed period is beneficial for preserving battery power as well as ensuring reliable ignition of the candle. In order to achieve such a timed characteristic, the power control circuit 830 can be implemented as illustrated in FIG. 16. The circuit 830 here comprises a power field effect transistor PFET1 connected at its source and drain electrodes in series with the glowplug 120. A gate electrode of the transistor PFET1 is connected to first terminals of a timing capacitor $C_3$ and discharge resistor $R_{30}$. Second terminals of the capacitor $C_3$ and the resistor $R_{30}$ are connected to the negative supply potential (−) of the battery 62. The gate electrode is also connected via the switch SW1 to the positive supply potential (+) from the battery 62.

The PFET1 has a gate-source threshold voltage $V_T$ of substantially 1 volt. Gate-source bias voltages in excess of 1 volt applied to the PFET1 results in the PFET1 providing a low-resistance path, for example in the order of 100 mohms, between its drain and source electrodes whereas gate-source bias voltages of less than 1 volt cause the PFET1 to be substantially nonconducting, namely exhibiting leakage currents of less than 5 μA, between its source and drain electrodes. The PFET1 is arranged to exhibit an abrupt transition between its low-resistance and non-conducting states at around the threshold voltage $V_T$ in order to circumvent excessive heating within the PFET1 when switching from the low-resistance state to the non-conducting state.

In operation, the transistor PFET1 is initially substantially non-conducting so that insignificant current flows through the glowplug 120. When the switch SW1 is momentarily depressed, the capacitor $C_3$ becomes charged to more than 1 volt potential difference thereacross causing the transistor PFET 1 to conduct, thereby energizing the glowplug 120. After a period of time defined by a time constant of the capacitor $C_3$ and the resistor $R_{30}$, the potential difference across the capacitor $C_3$ falls to less than 1 volt causing the PPET1 to attain a substantially non-conducting state, thereby conserving battery power and inhibiting current supply to the glowplug 120. If the user maintains the switch SW1 depressed, power is delivered to the glowplug 120 until combustion within the candle severs electrical connections to the glowplug 120.

Interlocking the generating unit 16 to the cap 12 immediately after ignition of the unit 16 is desirable for safety considerations. Such interlocking can be applied to the lateral projections 56*a*, 56*b* using appropriate locking mechanisms included within the cap 12. The locking mechanisms preferably are based on one or more of the following approaches:

(a) the locking mechanisms preferably include one or more bimetallic strips or bimorphs which deflect to lock the projections 56*a*, 56*b* when the temperature of the generating unit 16 increases in use, for example with regard to the temperature of oxygen supplied to the cap 12 from the generating unit 16;

(b) the locking mechanisms preferably include one or more deflectable pressure sensitive diaphragms, the generating unit 16 being under positive internal pressure relative to ambient when in operation, the one or more diaphragms being deflected by the positive pressure to lock onto the projections 56*a*, 56*b*; and (c) the generating unit 16 preferably includes one or more sacrificial binding members which lock onto the projections 56*a*, 56*b*, the sacrificial members being consumed during operation of the candle thereby rendering the generating unit 16 releasable from the cap 12 after the candle has been consumed.

Approaches (a) and (b) have a drawback in that the generating unit 16 can be released for a short period immediately after ignition before released oxygen pressure and temperature increase. Approach (c) has the drawback that the generating unit 16 once installed onto the cap 12 cannot be removed from the cap 12 even if the unit 16 has not been ignited. In practice, a combination of the processes is preferably employed.

It will be appreciated that the candle of the generator 10 can be ignited by any means imparting sufficient energy to ignite the ignition stage 72 to raise the temperature of the metal fuel therein sufficiently for it to burn in the presence of oxygen produced by the action of heat on chlorate or perchlorate material comprising the ignition stage 72. Although electrical or electronic ignition of the ignition stage 72 is described in the foregoing, it will be appreciated that percussion cap or cartridge ignition methods could alternatively be employed.

The generator 10 preferably includes one or more of an integral particulate filter and an integral chemical filter. The one or more filters can be included in one or more of the generating unit 16, the cap 12, in-line with the tube 20 and the headset 22.

Oxygen cooling by way of adiabatic expansion is preferably also implemented if additional cooling of oxygen to the user is desired, such adiabatic cooling requiring the generating unit 16 to be operated at positive internal pressure relative to ambient. Such positive internal pressure is compatible with approach (b) above for locking the generating unit 16 to the cap 12 in use. Higher operating pressure within the generating unit 16 in the vicinity of the candle results in a higher operating temperature therein which assists to maintain combustion. As a consequence, the iron fuel content within the candle can potentially be reduced, thereby enabling a higher proportion of metal chlorate to be included within the candle to enhance oxygen delivery therefrom. If the candle is operated at a sufficiently high pressure, adiabatic expansion can be used during oxygen delivery to cool a peripheral surface of the generating unit 16 to ambient temperature or even below ambient temperature. However, immediately after the candle has been burnt and oxygen delivery therefrom has ceased, the generating unit 16 will heat up at its peripheral surface as thermal energy from the burnt candle and the insulator 40 is conducted out to the peripheral surface.

Figure 17:
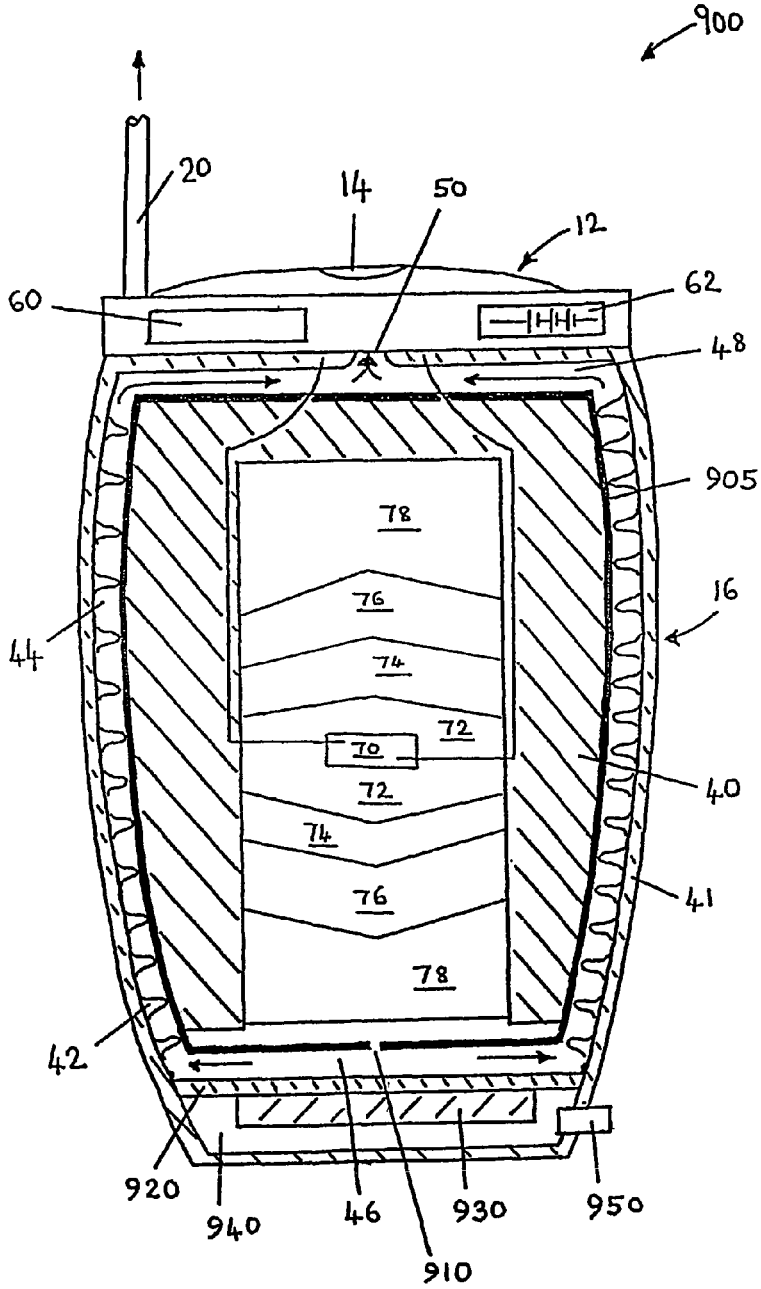
FIG. 17 is a schematic diagram of the generator in FIG. 4 modified to include adiabatic cooling in the generating unit with an additional evaporative cooling interface incorporated at a base region of the generating unit.

The generator 10 in FIG. 4 can be modified to provide an alternative oxygen generator indicated by 900 in FIG. 17. The alternative generator 900 is similar to the oxygen generator 10 except that it includes a metallic pressure containment vessel 905 surrounding the insulator 40 and the candle. The vessel 905 includes two holes at its upper end through which electrical wires to the ignition device are conveyed. Moreover, there is formed a central aperture 910 in a lower end of the vessel 905 through which oxygen generated in operation within the vessel 905 passes into the lower cavity 46. The cavity 46 in the generator 900 is bounded at its lower end by a first major face of an aluminium plate 920. A second major face of the plate 920 isolated from the cavity 46 includes a porous block 930 of material including a cooling fluid component, the component capable of evaporating on heating to provide cooling of the plate 920. The casing 41 and the plate 920 define an expansion cavity 940 including a venting valve 950 including a pressure rupturable membrane.

Operation of the generator 900 will now be described with reference to FIG. 17. A user of the generator 900 twist engages the generating unit 16 onto the cap 12 and then depresses the button 14 to ignite the candle. The candle ignites causing oxygen to be generated from the metal chlorate material therein and a relatively high pressure of several atmospheres to be developed within the vessel 905. Oxygen gas is ejected through the aperture 910 into the lower cavity 46 which, in operation, is at substantially atmospheric pressure of 1 Bar. On account of a pressure differential developed across the aperture 910 by virtue of oxygen flow therethrough, adiabatic expansion of the oxygen occurs such the oxygen in the cavity 46 is cooler in comparison to oxygen within the vessel 905. On account of the oxygen ejected through the aperture 910 having a relatively high velocity, it impinges onto the plate 920 and breaks into turbulent vortices as it propagates radially outwards within the cavity 46. The oxygen impinging onto the plate 920 transfers thermal energy to the plate 920 if the plate 920 is cooler than the oxygen ejected. The plate 920 heats up to a temperature at which fluid component within the block 930 evaporates to a corresponding vapour to build up pressure within the expansion cavity 940. When the pressure within the cavity 940 reaches a threshold pressure, the membrane in the valve 950 ruptures allowing substantially unimpeded flow of the vapour from the cavity 940. By such evaporation, the plate 920 is maintained at a temperature which does not exceed a boiling temperature of the fluid component, thereby ensuring that the temperature of the oxygen within the cavity 46 does not substantially exceed the boiling temperature of the component. When the fluid component comprises mostly water, the ejected oxygen gas within the cavity 46 is limited to a temperature of 100° C. If required, the fluid component can include a fragrance so that the generator 900 emits a pleasing smell to ambient when in operation.

Figure 18:
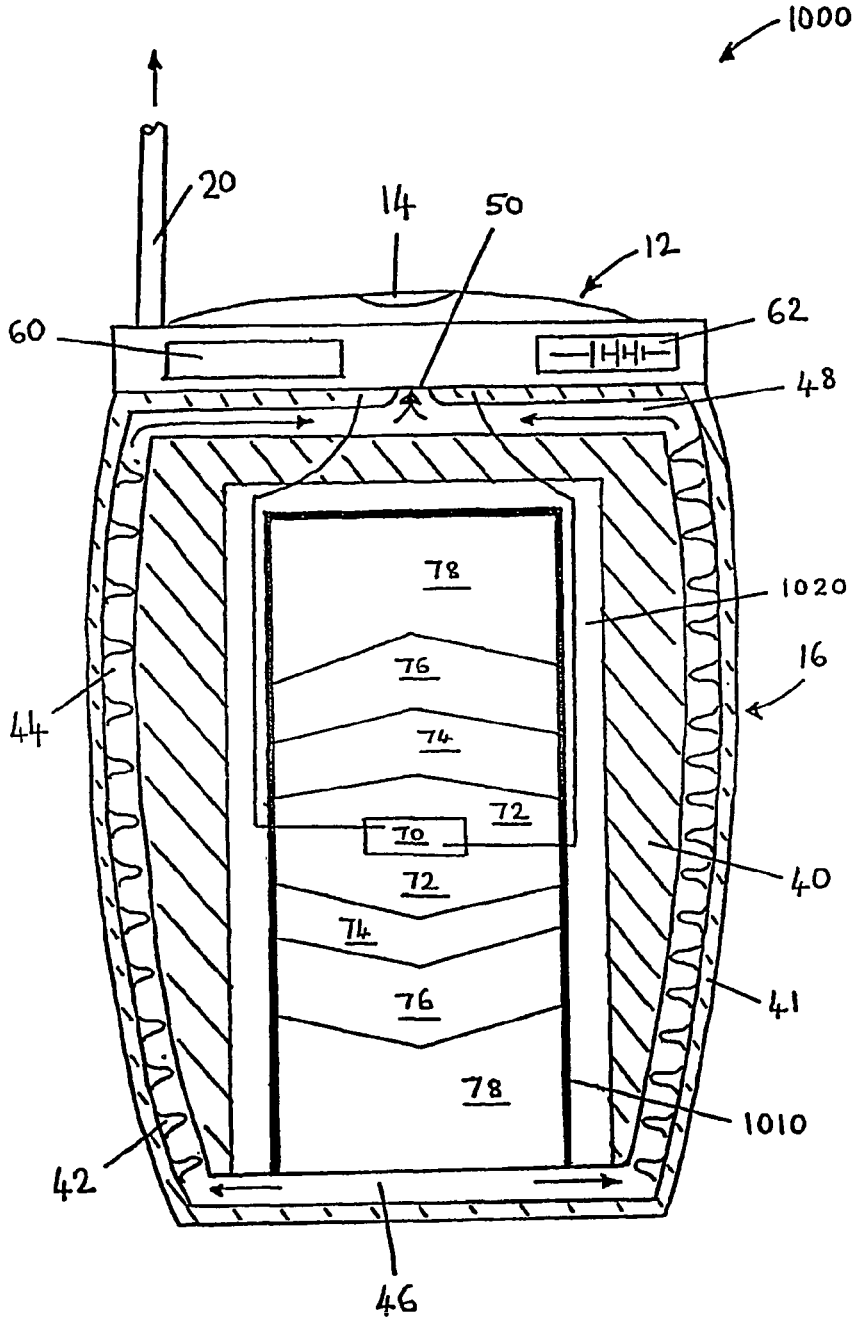
FIG. 18 is a schematic diagram of the generator in FIG. 4 modified to include a peripheral metal chlorate sleeve around its candle for endothermic cooling purposes.

The inventors have appreciated that the endothermic decomposition of metal chlorate to corresponding metal chloride and gaseous oxygen can be used to absorb thermal energy reaching the insulator 40, thereby enabling an exterior peripheral surface of the casing 41 to be maintained at a lower temperature during operation. Referring to FIG. 18, there is illustrated another alternative oxygen generator indicated by 1000, the alternative generator 1000 being similar to the generator 10 depicted in FIG. 4 except that the candle is surrounded by a sleeve of woven fibre-glass material which, in turn, is surrounded by a metal chlorate sleeve 1020 devoid of a fuel component.

In operation, the fibre-glass sleeve 1010 provides a thermal break between the candle and the chlorate sleeve 1020. Thermal energy conducted through the fibre-glass sleeve 1010 causes endothermic decomposition of the chlorate sleeve, thereby absorbing the thermal energy and resulting in less thermal energy transfer to the insulator 40. As a consequence of such endothermic thermal absorption, the insulator 40 can, if required, be made correspondingly thinner. The chlorate sleeve 1010 provides an additional benefit in that burn fronts propagating within the candle when ignited do not encroach onto the insulator 40 but are quenched within the chlorate sleeve 1020. If required, the chlorate sleeve 1020 can be implemented as a cast component, as a collection of metal chlorate pellets, or as a stack of metal chlorate material ring-like components.

It will be appreciated that adiabatic cooling as illustrated in FIG. 17 can be applied to the generator 1000 illustrated in FIG. 18.

The invention claimed is:

1. An oxygen generating apparatus comprising:

(a) a chemical oxygen generator structured for generating oxygen when ignited; and (b) an ignition component operatively coupled to the generator and structured to ignite the generator, the generator comprising at least one first element positioned and arranged for ignition by the ignition component, and a plurality of second elements each positioned and arranged for ignition by a first element, so that in operation a plurality of burn fronts is propagated through the at least one first element and through the plurality of second elements, the direction of propagation of one of the burn fronts differing from the direction of propagation of at least one other of the burn fronts.

2. An oxygen generating apparatus according to claim 1, wherein, in operation, the burn fronts propagate in generally mutually opposite directions.

3. An oxygen generating apparatus as claimed in claim 1, wherein the oxygen generator has a generally cylindrical configuration, a length and a diameter, the ignition component is located in a central region of the oxygen generator, and the length of the oxygen generator being greater than the diameter of the oxygen generator so that in operation two burn fronts are propagated from the central region toward opposite ends of the generator.

4. An oxygen generating apparatus according to claim 1, wherein the oxygen generator comprises one or more of a metal chlorate and metal perchlorate material system for generating oxygen.

5. An oxygen generating apparatus according to claim 1 wherein the oxygen generator is materially step-wise graded spatially away from the ignition means into stages.

6. An oxygen generating apparatus according to claim 5, wherein the stages are progressively more chemically inert with distance from the ignition component.

7. An oxygen generating apparatus according to claim 1, wherein the ignition component comprises at least one member selected from the group consisting of an electrically resistive heating device, a percussion cap detonator and a cartridge ignition device.

8. An oxygen generating apparatus according to claim 1, wherein the oxygen generator includes an insulation component effective for reducing the rate of thermal energy flow from an interior region of the oxygen generator during oxygen generation.

9. An oxygen generating apparatus according to claim 8, wherein the insulation component is fabricated from a microporous material capable of operating at temperatures of at least 1000° C.

10. An oxygen generating apparatus according to claim 1, wherein the oxygen generator comprises a peripheral path through which, in use, generated oxygen is conveyed for cooling the oxygen prior to dispensing the cooled oxygen to a user.

11. An oxygen generating apparatus according to claim 1, further comprising control means for controlling electrical power applied to the ignition component for igniting the ignition component, the control means including means for automatically controlling a period during which electrical power is applied to the ignition component for initiating combustion within the chemical oxygen generator.

12. An oxygen generating apparatus according to claim 1, further comprising insulating means for at least partially thermally isolating the chemical oxygen generator from ambient, the insulating means being fabricated from a microporous material capable of operating at temperatures of at least 1000° C.

13. An oxygen generating apparatus according to claim 1, further comprising a cap and an oxygen generating unit, the cap including a control component structured and positioned for controlling electrical power applied to the ignition component to initiate combustion within the chemical oxygen generator, and the oxygen generating unit including the chemical oxygen generator and the ignition component, wherein the cap and the chemical oxygen generator include interlocking elements structured for locking the cap and the chemical oxygen generator together when in operation.

14. An oxygen generating apparatus comprising:

(a) a chemical oxygen generator structured for generating oxygen when ignited, and (b) an ignition component operatively coupled to the generator, and (c) an insulation component, wherein, in operation, the generator sustains propagation of a plurality of burn fronts therethrough, the fronts propagating in generally mutually opposite directions, the generator comprising an elongate oxygen-generating candle and the ignition component is positioned at a substantially longitudinally central location of the generator, the candle including a material step-wise graded spatially away from the ignition component, the material being progressively more chemically inert with distance from the ignition component.

* * * * *